US008631900B2

(12) United States Patent
Miyake et al.

(10) Patent No.: US 8,631,900 B2
(45) Date of Patent: Jan. 21, 2014

(54) SOUND INSULATION FLOOR STRUCTURE AND SOUND INSULATION FLOOR COMPONENT AS WELL AS METHOD FOR REDUCING FLOOR IMPACT SOUND

(75) Inventors: Noboru Miyake, Zentsuji (JP); Masahiko Takamatsu, Zentsuji (JP); Hideki Kanezako, Zentsuji (JP); Kazutoshi Hirata, Zentsuji (JP); Kohei Hayashi, Okayama (JP); Sumito Kiyooka, Okayama (JP); Atsumi Adachi, Osaka (JP); Masaru Koike, Tsuchiura (JP); Satoshi Koizumi, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 0 days.

(21) Appl. No.: 13/582,348

(22) PCT Filed: Mar. 3, 2011

(86) PCT No.: PCT/JP2011/054962

§ 371 (c)(1),
(2), (4) Date: Aug. 31, 2012

(87) PCT Pub. No.: WO2011/111608

PCT Pub. Date: Sep. 15, 2011

(65) Prior Publication Data

US 2013/0025965 A1 Jan. 31, 2013

(30) Foreign Application Priority Data

Mar. 8, 2010 (JP) ..... 2010-050842
Sep. 9, 2010 (JP) ..... 2010-202495
Nov. 15, 2010 (JP) ..... 2010-254762

(51) Int. Cl.
*E04B 1/82* (2006.01)

(52) U.S. Cl.
USPC ..... 181/290; 181/284; 181/207

(58) Field of Classification Search
USPC ..... 181/290, 284, 207
See application file for complete search history.

(56) References Cited

U.S. PATENT DOCUMENTS 4,888,927 A 12/1989 Yoshimi et al.
RE41,945 E * 11/2010 Downey ..... 52/144

(Continued)

FOREIGN PATENT DOCUMENTS

JP 61 163842 10/1986
JP 63 558 1/1988

(Continued)

OTHER PUBLICATIONS

International Search Report Issued May 17, 2011 in PCT/JP11/54962 Filed Mar. 3, 2011.

*Primary Examiner* — Forrest M Phillips
(74) *Attorney, Agent, or Firm* — Oblon, Spivak, McClelland, Maier & Neustadt, L.L.P.

(57) ABSTRACT

A sound insulation floor structure comprises a floor backing member, a floor finishing layer, and an intermediate layer between the floor backing member and the floor finishing layer, the intermediate layer comprising a buffer member comprising a nonwoven structure. The nonwoven structure comprises a thermal adhesive fiber under moisture which is melt-bonded to a fiber of the nonwoven structure to fix the fibers. For example, the sound insulation floor structure may comprise, in sequence, a floor backing member 1, a buffer layer 2, an air layer 3, a hard layer 4, and a floor finishing layer 5. In the floor structure, a support member 6 is disposed between the buffer layer 2 and the hard layer 4. The support member may occupy 10 to 70% of a floor area. The sound insulation floor structure prevents subsidence of a floor member due to walking, achieves comfortableness to walk, and has improved floor impact sound insulation.

26 Claims, 4 Drawing Sheets

(56) References Cited

U.S. PATENT DOCUMENTS

| | | | | |
|---|---|---|---|---|
| 7,909,136 | B2 * | 3/2011 | Surace et al. | 181/290 |
| 7,921,965 | B1 * | 4/2011 | Surace | 181/290 |
| 8,157,051 | B2 * | 4/2012 | Marcel et al. | 181/290 |
| 2005/0023080 | A1 * | 2/2005 | Tompson et al. | 181/296 |
| 2005/0103564 | A1 * | 5/2005 | Duval et al. | 181/204 |

FOREIGN PATENT DOCUMENTS

| | | | | | |
|---|---|---|---|---|---|
| JP | 4 85453 | | 3/1992 | | |
| JP | 4 194150 | | 7/1992 | | |
| JP | 8 105192 | | 4/1996 | | |
| JP | 9 32246 | | 2/1997 | | |
| JP | 3013023 | | 12/1999 | | |
| JP | 2003 56171 | | 2/2003 | | |
| JP | 2003056171 | A * | 2/2003 | | E04F 15/18 |
| JP | 2004 44315 | | 2/2004 | | |
| JP | 2005 256439 | | 9/2005 | | |
| JP | 2009 84715 | | 4/2009 | | |
| JP | 2009084715 | A * | 4/2009 | | |
| WO | 2007 116676 | | 10/2007 | | |

* cited by examiner

SOUND INSULATION FLOOR STRUCTURE AND SOUND INSULATION FLOOR COMPONENT AS WELL AS METHOD FOR REDUCING FLOOR IMPACT SOUND

TECHNICAL FIELD

The present invention relates to sound insulation floor structures and components useful for reducing floor impact sounds (for example, a floor impact sound from upstairs in a multi-storied building) and to methods for reducing floor impact sounds.

BACKGROUND ART

Sound insulation floor structures are applied to multi-storied (or multi-story) buildings (e.g., an apartment house or a condominium, a building, and a dwelling house) in order to reduce floor impact sounds from upstairs. The floor impact sounds include a light-weight impact sound (a relatively high-frequency sound wave) [such as an impact sound caused by dropping of tableware such as a spoon or an impact sound caused by walking with house shoes (or slippers)], an impact sound (a relatively low-frequency sound wave) [such as an impact sound caused by jumping of a child down from a sofa or an impact sound caused by noisily walking], and the like. The sound insulation floor structures are desirable to have wide-ranging impact sound insulation. It is known that the sound insulation floor structures are mainly obtainable by a method of pasting a buffer member on a wood board having a rear side provided with a plurality of kerfs (a method using what is called a direct pasted sound insulation floor member), a method of disposing a damping member (a sound insulation member) between a floor member and a floor backing member, or the like.

As a method using combination of a kerf and a buffer member, for example, Japanese Patent Application Laid-Open Publication No. 2004-44315 (JP-2004-44315A, Patent Document 1) discloses a soundproof floor member comprising a split board, a plywood base member having a plurality boards laminated and unified, and a groove section bored in the plywood base member; the split board is obtained by splitting a molding original sheet of a medium-density fiber board into the plural in a thickness direction thereof and has a hard layer on one side thereof; the hard layer lies in a front side of the soundproof floor member; and the split board is laminated and unified on a front side of the plywood base member. The plywood base member has the first outermost layer that is thinned in an approximately half of a normal layer lower than the first outermost layer, and the groove section is bored from a rear side of the plywood base member to the second outermost layer. When an impact is made on a floor, the soundproof floor member undergoes deformation of the wood board due to a plurality of kerfs provided on the rear side of the wood board. Since the deformed portion serves as a buffer to absorb the impact, the soundproof floor member shows an excellent effect on impact sources, in particular, a light-weight floor impact source. This document also discloses that the floor member has a strength enough to stand a load applied via casters in moving an object with casters on a floor by providing the hard portion comprising the medium-density fiber board on the front side of the plywood base member.

For the method using combination of the kerf and the buffer member, however, the wood board is locally deformed in a region loaded by walking (that is, the floor member subsides) even when the specific medium-density fiber board is disposed on the surface side. Thus there is an uncomfortable foot-step feeling during walking. Further, the floor has a small sound insulation effect on a heavy floor impact sound (for example, a relatively low-frequency sound wave), probably because the floor has a small space volume due to the insufficient size of the kerf.

As a method of interposing a damping member between a floor member and a floor backing member, for example, Japanese Patent No. 3013023 (JP-3013023B, Patent Document 2) discloses a sound insulation component for reducing a floor impact sound, in which a mixture containing 100 parts by weight of a petroleum-based asphalt, 2 to 10 parts by weight of a thermoplastic elastomer, 100 to 400 parts by weight of a mineral grain, 100 to 800 parts by weight of an iron powder, and 0.1 to 1 parts by weight of a surfactant is sandwiched between sheets, each consisting of a felt or a nonwoven fabric, and molded into a plate-like form.

The floor member provided with the damping member (the sound insulation component) is only slightly deformed due to walking and comfortable to walk, while the floor member has a lower ability to insulate a floor impact sound compared with the sound insulation floor member comprising combination of the kerf and the buffer member.

Incidentally, International Publication No. WO2007/116676 (Patent Document 3) discloses that a nonwoven fiber assembly containing a thermal adhesive fiber under moisture is heat-treated with a high-temperature water vapor to produce a hard shaped product having a nonwoven structure (or nonwoven fabric structure) and having the thermal adhesive fiber melt-bonded at a uniform bonded ratio in a thickness direction. This document discloses that the hard shaped product is available for a building board. This document is, however, silent on floor structures or sound insulation properties.

RELATED ART DOCUMENTS

Patent Documents

Patent Document 1: JP-2004-44315A (claim 1, paragraphs [0010][0012][0014], FIGS. 1 and 3)
Patent Document 2: JP-3013023B (claim 1, FIGS. 2 and 3)
Patent Document 3: International Publication No. WO2007/116676 (Claims, Examples)

SUMMARY OF THE INVENTION

Problems to be Solved by the Invention

It is therefore an object of the present invention to provide a sound insulation floor structure and a sound insulation floor component which prevent subsidence of a floor member due to walking, achieve comfortableness to walk, and have improved floor impact sound insulation (or a high insulation of a floor impact sound), as well as a method for reducing a floor impact sound.

Another object of the present invention is to provide a sound insulation floor structure and a sound insulation floor component which block off a floor impact sound from upstairs in a multi-storied building over a wide frequency range including a low-frequency zone, as well as a method for reducing a floor impact sound.

It is still another object of the present invention to provide a sound insulation floor structure and a sound insulation floor component which have an excellent safety in falling down, as well as a method for reducing a floor impact sound.

Means to Solve the Problems

The inventors of the present invention made intensive studies to achieve the above objects and finally found that an intermediate layer being between a floor backing member and a floor finishing layer and comprising a buffer member formed with a specific nonwoven structure prevents subsidence of a floor member due to walking, achieves comfortableness to walk, and has improved floor impact sound insulation. The present invention was accomplished based on the above findings.

That is, the sound insulation floor structure of the present invention comprises a floor backing member, a floor finishing layer, and an intermediate layer between the floor backing member and the floor finishing layer, and the intermediate layer comprises a buffer member comprising a nonwoven structure. The nonwoven structure comprises a thermal adhesive fiber under moisture (or moistenable-thermal adhesive fiber, moistenable adhesive fiber under heat, or adhesive fiber under heat moisture) which is melt-bonded to a fiber of the nonwoven structure to fix the fibers. The intermediate layer is formed with a plurality of joists and buffer layers; the joists and the buffer layers are disposed alternately; the joists are disposed parallel to each other at intervals; and the joists and/or the buffer layers may comprise a buffer member.

The sound insulation floor structure of the present invention may comprise, in sequence, the intermediate layer, an air layer (or an empty space layer), a hard layer, and the floor finishing layer, and may further comprise a support member in the air layer between the intermediate layer and the hard layer. The support member of the floor structure may have a quadrangular cross section and be long, a plurality of the support members may be disposed parallel to each other at intervals, and the support members may occupy 10 to 70% of a floor area. In the floor structure, the joists may include a joist perpendicular to the long support member to partly support the hard layer.

The sound insulation floor structure of the present invention may have a structure in that the buffer layer is a compressed layer obtainable by providing a compressable layer comprising the buffer member and having a thickness larger than a thickness of each one of the joists, and compressing the compressable layer to a thickness of the joist. The sound insulation floor structure may comprise a first hard layer between the floor backing member and the buffer layer, and a second hard layer between the buffer layer and the floor finishing member. The nonwoven structure for forming the buffer member of the sound insulation floor structure may have a bonded fiber ratio (or ratio of bonded fiber) of 3 to 85% and an apparent density of 0.03 to 0.2 g/cm$^3$.

In the sound insulation floor structure of the present invention, the joists each may contain the buffer member, and the nonwoven structure for forming the buffer member may have a bonded fiber ratio of 3 to 85% and an apparent density of 0.07 to 0.35 g/cm$^3$.

In the sound insulation floor structure, the joists may be disposed parallel to a beam which is positioned between adjacent joists. The buffer layers and the joists may be disposed alternately and adjacently. The sound insulation floor structure may further comprise a damping layer between the floor backing member and the floor finishing layer. The damping layer may contain an asphalt. There may be a clearance between the intermediate layer and a surface of a wall.

The present invention also includes a sound insulation floor component comprising: a plurality of joists to be disposed parallel to each other at intervals, and a plurality of compressable layers, each having a thickness larger than a thickness of each one of the joists, the joists and the compressable layers are disposed alternately; the joists and/or the compressable layers contain a buffer member, the buffer member comprises a nonwoven structure, and the nonwoven structure comprises a thermal adhesive fiber under moisture which is melt-bonded to a fiber of the nonwoven structure to fix the fibers. The compressable layers and the joists may be disposed alternately and adjacently. Each one of the compressable layers may comprise a buffer layer comprising a buffer member, and the buffer layer may have a thickness of 1.05 to 3 times as large as the thickness of each one of the joists. Each one of the compressable layers may comprise a buffer layer comprising the buffer member and a non-buffer layer laminated on one side of the buffer layer, and the buffer layer may have a thickness of 1.05 to 3 times as large as a reference thickness; the reference thickness is determined by subtracting the thickness of a non-buffer layer from the thickness of each one of the joists. The non-buffer layer may comprise a damping member. The non-buffer layer may form a space portion (or an air portion). In the sound insulation floor component, the area ratio of the joists and the compressable layers in a floor area may be 10/90 to 30/70 in a ratio of the joists/the compressable layers. In the compressable layer, the buffer layer uncompressed (or before compression) may comprise a nonwoven structure having a thickness of 3 to 60 mm and an apparent density of 0.03 to 0.2 g/cm$^3$. The sound insulation floor component may further comprise a damping layer. The damping layer may contain an asphalt. The joists may be disposed parallel to each other at intervals on one side of a first hard layer. The joists and the compressable layers may be fixed to the first hard layer with an adhesive or a pressure sensitive adhesive. The sound insulation floor component of the present invention may further comprise a second hard layer disposed on the joists and the compressable layers, and each one of the compressable layers may be compressed to a thickness of each one of the joists. The joists and the compressable layers may be fixed to the second hard layer with an adhesive or a pressure sensitive adhesive. The sound insulation floor component of the present invention may further comprise a damping layer, fixed with an adhesive or a pressure sensitive adhesive, between the first hard layer or the second hard layer and an arrangement of the joists and the compressable layers.

The present invention also includes a method for reducing a floor impact sound, which comprises using a buffer member; the buffer member comprises a nonwoven structure containing a thermal adhesive fiber under moisture which is melt-bonded to a fiber of the nonwoven structure to fix fibers. In particular, the method may reduce a floor impact sound from upstairs in a multi-storied building.

As used herein, the term "joist" means a rod-like (bar-like or long), block-like, or board-like support member to be disposed under the floor for the purpose of supporting a floor board such as a wood board (or wooden board) or a floor finishing member. In order to further improve the sound insulation performance, the joist (or the support member) may have an elastic body or the like fixed on part or whole of an upper side and/or a lower side thereof. When the elastic body or the like is fixed on the support member, the thickness of the joist means a total thickness including the joist and the elastic body or the like. As used herein, the "joist" also means, for example, a rod-like (bar-like or long), block-like, or board-like support member to be disposed on a concrete slab surface in an RC building or on a floor backing member in a wooden building. As used herein, the term "edge joist" refers to one of the joists and means a joist provided (or installed or placed) around (all around) an edge of a room so that the joist can be in contact (or almost contact) with a wall of the room.

Effects of the Invention

According to one aspect of the present invention, since a floor structure comprises an intermediate layer, which is interposed between a floor backing member and a floor finishing layer, comprising a buffer member formed with a specific nonwoven structure comprising a thermal adhesive fiber under moisture which is melt-bonded to a fiber for the nonwoven structure to fix the fibers, the floor structure is prevented from subsiding caused by walking. In addition, the floor structure achieves comfortableness to walk and has improved floor impact sound insulation.

When the intermediate layer is formed with a plurality of joists disposed parallel to each other at intervals and a plurality of buffer layers while disposing the joists and buffer layers alternately, and the floor structure comprises, in sequence, the intermediate layer, an air layer, a hard layer having no kerf formed thereon, and the floor finishing layer and further comprises a support member in the air layer between the buffer layer and the hard layer; the hard layer is bonded to the floor finishing layer in tight contact, and there is a space portion between the buffer layer and the hard layer by the support member. The floor structure therefore has a large space portion compared with a conventional floor structure having a kerf and allows a floor impact sound from upstairs in a multistoried building to be blocked in a wide frequency range including a low-frequency zone. Thus the floor structure can achieve effective insulation against both light-weight floor impact sound and heavy floor impact sound.

Moreover, a floor structure having a moderate and uniform hardness can be achieved by compressing a compressable layer having a thickness larger than the thickness of the joist to the thickness of the joist in the intermediate layer, and the floor structure also has an excellent safety in falling down.

When the sound insulation floor structure further comprises a damping layer, the floor structure can reduce a vibration derived from a floor impact source by the damping effect to improve floor impact sound insulation. In particular, a damping layer containing an asphalt not only can achieve improved floor impact sound insulation but also can improve comfortableness to walk.

Further, the buffer layer comprising the buffer member can ensure a withstand load while maintaining a buffering property providing insulation against a high-frequency floor impact sound (particularly, a light-weight floor impact sound). In addition, combination of the buffer layer and the joist can improve the strength of the floor member and highly prevent the subsidence or the like. Moreover, the joist formed with the buffer member can prevent a vibration spreading through the joist and improve insulation against a further high-frequency floor impact sound.

DESCRIPTION OF EMBODIMENTS

Figure 1:
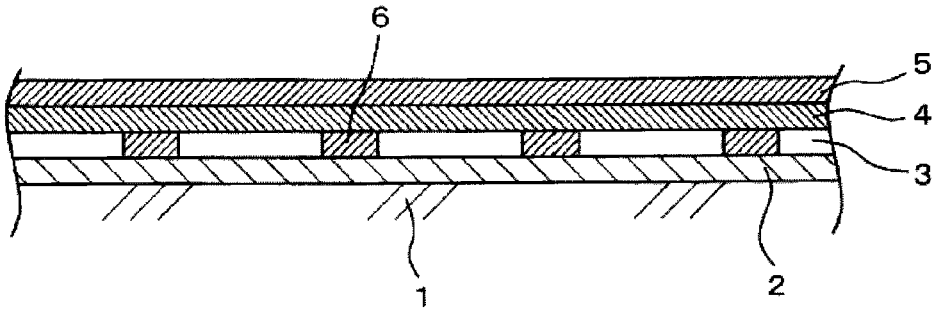
FIG. 1 is a schematic cross-sectional view of a sound insulation floor structure A in accordance with an embodiment of the present invention.

The sound insulation floor structure of the present invention comprises a floor backing member, a floor finishing layer, and an intermediate layer between the floor backing member and the floor finishing layer; the intermediate layer comprises a buffer member. The sound insulation floor structure is characterized in that the buffer member comprises (or is formed with) a specific nonwoven structure.

[Buffer Member]

In the present invention, the buffer member comprises a nonwoven structure. The nonwoven structure comprises a thermal adhesive fiber under moisture and has fibers (or fibers of the nonwoven structure) fixed by melting (melt-bonding) of the thermal adhesive fiber.

In the nonwoven structure, the thermal adhesive fiber under moisture comprises at least a thermal adhesive resin under moisture. It is sufficient that the thermal adhesive resin under moisture can flow (or melt) or easily deform and exhibit adhesiveness at a temperature reached easily with an aid of a high-temperature water vapor.

Specifically, the thermal adhesive resin under moisture may include a thermoplastic resin which softens with (or by) a hot water (e.g., a water having a temperature of about 80 to 120° C. and particularly about 95 to 100° C.) to bond to itself or to other fibers, for example, a vinyl alcohol-series polymer (e.g., an ethylene-vinyl alcohol copolymer), a polylactic acid-series resin (e.g., a polylactic acid), and a (meth)acrylic copolymer containing a (meth)acrylamide unit. Further, the thermal adhesive resin under moisture may also include an elastomer which can easily flow (melt) or deform and exhibit adhesiveness with an aid of a high-temperature water vapor (for example, a polyolefin-series elastomer, a polyester-series elastomer, a polyamide-series elastomer, a polyurethane-series elastomer, and a styrene-series elastomer). These thermal adhesive resins under moisture may be used singly or in combination. Among the thermal adhesive resins under moisture, the particularly preferred one includes a vinyl alcohol-series polymer containing an $\alpha$-$C_{2-10}$olefin unit such as ethylene or propylene, particularly, an ethylene-vinyl alcohol-series copolymer.

The ethylene unit content in the ethylene-vinyl alcohol-series copolymer (the degree of copolymerization) may be, for example, about 5 to 65 mol % (e.g., about 10 to 65 mol %), preferably about 20 to 55 mol %, more preferably about 30 to 50 mol %. The ethylene unit content within the above-mentioned range provides a thermal resin under moisture having a unique behavior. That is, the thermal resin under moisture has thermal adhesiveness under moisture and insolubility in hot water. An ethylene-vinyl alcohol-series copolymer having an excessively small ethylene unit content readily swells or becomes a gel by a water vapor having a low temperature (or by water), whereby the copolymer readily deforms when once getting wet. On the other hand, an ethylene-vinyl alcohol-series copolymer having an excessively large ethylene unit content has a low hygroscopicity. In such a case, it is difficult to allow the copolymer to melt and bond the fibers constituting the nonwoven structure by an application of moisture and heat, whereby it is difficult to produce a structure having strength for practical use. The ethylene unit content is, in particular, in the range of 30 to 50 mol % provides a structure having an excellent processability (or formability) into a sheet or a board (or a plate).

The degree of saponification of vinyl alcohol unit in the ethylene-vinyl alcohol-series copolymer is, for example, about 90 to 99.99 mol %, preferably about 95 to 99.98 mol %, and more preferably about 96 to 99.97 mol %. An excessively small degree of saponification degrades the heat stability of the copolymer to cause a thermal decomposition or a gelation, whereby the stability of the copolymer is deteriorated. On the other hand, an excessively large degree of saponification makes the production of the thermal adhesive fiber under moisture difficult.

The viscosity-average degree of polymerization of the ethylene-vinyl alcohol-series copolymer can be selected according to need, and is for example, about 200 to 2500, preferably about 300 to 2000, and more preferably about 400 to 1500. An ethylene-vinyl alcohol-series copolymer having a viscosity-average degree of polymerization within the above-mentioned range provides a thermal adhesive fiber under moisture having an excellent balance between spinning property and thermal adhesiveness under moisture.

The cross-sectional form of the thermal adhesive fiber under moisture (a form or shape of a cross section perpendicular to the length direction of the fiber) may include not only a common solid-core cross section such as a circular cross section or a deformed (or modified) cross section [e.g., a flat form, an oval (or elliptical) form, and a polygonal form], but also a hollow cross-section. The thermal adhesive fiber under moisture may be a conjugated (or composite) fiber comprising a plurality of resins, at least one of which is the thermal adhesive resin under moisture. The conjugated fiber has the thermal adhesive resin under moisture at least on part or areas of the surface thereof. In order to bond the fibers, it is preferable that the thermal adhesive resin under moisture form a continuous area of the surface of the conjugated fiber in the length direction of the conjugated fiber. The coverage of the thermal adhesive resin under moisture is, for example, not less than 50%, preferably not less than 80%, and more preferably not less than 90% of the surface of the thermal adhesive fiber under moisture.

The cross-sectional structure of the conjugated fiber having the thermal adhesive fiber under moisture on the surface thereof, may include, e.g., a sheath-core form, an islands-in-the-sea form, a side-by-side form or a multi-layer laminated form, a radially-laminated form, and a random composite form. Among these cross-sectional structures, the structure preferred in terms of a high adhesiveness includes a sheath-core form structure in which the entire surface of the fiber is covered with the thermal adhesive resin under moisture (that is, a sheath-core structure in which a sheath part comprises the thermal adhesive resin under moisture). The fiber having a sheath-core structure may be a fiber in which a surface of a fiber comprising a fiber-forming (or fiber-formable) polymer other than the thermal adhesive resin under moisture is coated (or covered) with the thermal adhesive resin under moisture.

The conjugated fiber may comprise a combination of two or more of the thermal adhesive resins under moisture or a combination of the thermal adhesive resin under moisture and a non thermal adhesive resin under moisture. The non thermal adhesive resin under moisture may include a non water-soluble or hydrophobic resin, e.g., a polyolefinic resin, a (meth)acrylic resin, a vinyl chloride-series resin, a styrenic resin, a polyester-series resin, a polyamide-series resin, a polycarbonate-series resin, a polyurethane-series resin, and a thermoplastic elastomer. These non thermal adhesive resins under moisture may be used singly or in combination.

Among these non thermal adhesive resins under moisture, in terms of excellent heat resistance and dimensional stability, the preferred one includes a resin having a melting point higher than that of the thermal adhesive resin under moisture (particularly an ethylene-vinyl alcohol-series copolymer), for example, a polypropylene-series resin, a polyester-series resin, and a polyamide-series resin. In particular, the resin preferred in terms of an excellent balance of properties (e.g., both heat resistance and fiber processability) includes a polyester-series resin or a polyamide-series resin.

The proportion (mass ratio) of the thermal adhesive resin under moisture relative to the non thermal adhesive resin under moisture (a fiber-forming polymer) in the conjugated fiber can be selected according to the structure (e.g., a sheath-core form structure) and is not particularly limited to a specific one as far as the thermal adhesive resin under moisture is present on or forms the surface of the conjugated fiber. For example, the proportion of the thermal adhesive resin under moisture relative to the non thermal adhesive resin under moisture is about 90/10 to 10/90, preferably about 80/20 to 15/85, and more preferably about 60/40 to 20/80. An excessively large proportion of the thermal adhesive resin under moisture does not provide a conjugated fiber having strength. An excessively small proportion of the thermal adhesive resin under moisture makes it difficult to allow the thermal adhesive resin under moisture to be present on the surface of the conjugated fiber continuously in the length direction of the conjugated fiber, which lowers the thermal adhesiveness under moisture of the conjugated fiber. Such a tendency also appears in the conjugated fiber obtained by coating the surface of the non thermal adhesive fiber under moisture with the thermal adhesive resin under moisture.

The average fiber length of the thermal adhesive fiber under moisture can be selected from, for example, the range of about 10 to 100 mm, and is preferably about 20 to 80 mm and more preferably about 25 to 75 mm. A thermal adhesive fiber under moisture having an average fiber length within the above-mentioned range entangles with other fibers enough, whereby the mechanical strength of the nonwoven structure is improved.

The degree of crimp of the thermal adhesive fiber under moisture is, for example, about 1 to 50%, preferably about 3 to 40%, and more preferably about 5 to 30%. Moreover, the number of crimps is, for example, about 1 to 100 per 25 mm, preferably about 5 to 50 per 25 mm, and more preferably about 10 to 30 per 25 mm.

The nonwoven structure may further comprise a non thermal adhesive fiber under moisture in addition to the thermal adhesive fiber under moisture. The non thermal adhesive fiber under moisture may include a fiber comprising a non thermal adhesive resin under moisture constituting the conjugated fiber, and further a cellulose-series fiber (e.g., a rayon fiber and an acetate fiber). These non thermal adhesive fibers under moisture may be used singly or in combination. These non thermal adhesive fibers under moisture may be selected according to a required characteristic. Combination of the thermal adhesive fiber under moisture with a semi-synthetic fiber (such as a rayon) can provide a nonwoven structure having a relatively high density and a high mechanical property.

The proportion (mass ratio) of the thermal adhesive fiber under moisture relative to the non thermal adhesive fiber under moisture [the thermal adhesive fiber under moisture/the non thermal adhesive fiber under moisture] is about 100/0 to 20/80 (e.g., about 99/1 to 20/80), preferably about 100/0 to 50/50 (e.g., about 95/5 to 50/50), more preferably about 100/0 to 70/30, according to the kind or purpose of the panel. An excessively small ratio of the thermal adhesive fiber under moisture degrades the hardness of the nonwoven structure, whereby the easiness in handling (or easy-to-handle) of the nonwoven structure is difficult to maintain.

For the nonwoven structure comprising the thermal adhesive fiber under moisture, the fibers of the nonwoven structure are bonded by melt-bonding of the thermal adhesive fiber under moisture at a bonded fiber ratio of about 3 to 85% (e.g., about 5 to 600), preferably about 5 to 50% (e.g., about 6 to 40%), and more preferably about 6 to 35% (particularly about 8 to 30%). According to the present invention, since the fibers are bonded in such a range, each fiber has a high degree of freedom. Thus the nonwoven structure achieves a high sound insulation property (or a high noise insulation property). Further, in order to improve the strength, the bonded fiber ratio may be, for example, about 10 to 85%, preferably about 20 to 80%, and more preferably about 30 to 75%.

The bonded fiber ratio in the present invention can be determined by a method in Examples described later. The bonded fiber ratio means the proportion of the number of the cross sections of two or more fibers bonded in the total number of the cross sections of fibers in the cross section of the nonwoven structure. Accordingly, the low bonded fiber ratio means a low proportion of the melt-bond of a plurality of fibers (or a low proportion of the fibers melt-bonded to form bundles).

Moreover, in the present invention, the fibers constituting the nonwoven structure are bonded at the intersection points thereof. In order to produce a nonwoven structure having a high bending stress with the number of bonded points as less as possible, it is preferable that the bonded points uniformly distribute from the surface of the nonwoven structure, via inside (middle), to the backside of the nonwoven structure in the thickness direction. A concentration of the bonded points in the surface or inside not only tends to fail to provide a nonwoven structure having an excellent mechanical properties and formability but also lowers the form stability at a part having a small number of the bonded points.

Accordingly, it is preferable that the bonded fiber ratio in each of three areas in the cross section of the nonwoven structure be within the above-mentioned range. The above-mentioned three areas are obtained by cutting the nonwoven structure across the thickness direction and dividing the obtained cross section equally into three in a direction perpendicular to the thickness direction. In addition, the ratio of the minimum of the bonded fiber ratio relative to the maximum thereof in the three areas (the minimum/the maximum) (the ratio of the minimum bonded fiber ratio relative to the maximum bonded fiber ratio among the three areas) is, for example, not less than 50% (e.g., about 50 to 100%), preferably about 55 to 99%, and more preferably about 60 to 98% (particularly about 70 to 97%). Owing to such a uniform distribution of the bonded fiber ratio in the thickness direction, the nonwoven structure of the present invention has an excellent hardness or bending strength, folding endurance or toughness in spite of a small bonded area of the fiber. Further, due to the small bonded area of the fiber, there are many freely vibratable fibers, and the nonwoven structure has an excellent vibrational absorption. Thus, a sound wave passed through the floor member is absorbed by the nonwoven structure, and the solid-borne sound can be reduced. That is, the nonwoven structure in the present invention has both an adequate mechanical property for a board and an adequate sound absorption property for a nonwoven structure.

The nonwoven structure comprising the thermal adhesive fiber under moisture may be obtained by spraying a high-temperature water vapor having a temperature of about 70 to 150° C. (particularly about 80 to 120° C.) on a web composed of a staple fiber (for example, a semi-random web and a parallel web) at a pressure of about 0.1 to 2 MPa (particularly preferably about 0.2 to 1.5 MPa). The detailed production process may be referred to a production process described in International Publication No. WO2007/116676 (Patent Document 3).

When the buffer layer comprising the nonwoven structure is fixed to the floor backing member or the support member with an adhesive or a pressure sensitive adhesive, the adhesive or the pressure sensitive adhesive may infiltrate into the nonwoven structure and decrease the buffering effect. In order to prevent infiltration of the adhesive or the pressure sensitive adhesive, a sheet member (such as a film or a nonwoven fabric) may be laminated on a front side and/or a rear side of the nonwoven structure.

The average fineness of the fiber of the nonwoven structure can be selected, according to the applications, for example, from the range of about 0.01 to 100 dtex, and is preferably about 0.1 to 50 dtex and more preferably about 0.5 to 30 dtex (particularly about 1 to 10 dtex). A thermal adhesive fiber under moisture having an average fineness within the above-mentioned range has excellent sound insulation property and sound absorption property.

The apparent density of the nonwoven structure can be selected from the range of about 0.02 to 0.5 g/cm$^3$ according to the site at which the nonwoven structure is used or the species of the nonwoven structure.

When the buffer member is used as a buffer layer, the nonwoven structure has an apparent density of, for example, about 0.03 to 0.2 g/cm$^3$ (e.g., about 0.03 to 0.15 g/cm$^3$), preferably about 0.04 to 0.18 g/cm$^3$, and more preferably about 0.05 to 0.15 g/cm$^3$. A nonwoven structure having an excessively low apparent density has an improved sound insulation property while lowering the comfortableness to walk due to a low hardness thereof. In contrast, a nonwoven structure having excessively high apparent density has a lowered sound insulation property.

On the other hand, when the buffer member is used as a joist or when the joist is not used, the nonwoven structure has an apparent density of, for example, about 0.05 to 0.4 g/cm$^3$, preferably about 0.07 to 0.35 g/cm$^3$, and more preferably about 0.1 to 0.3 g/cm$^3$. When the apparent density of the nonwoven structure is too low, a floor structure comprising the nonwoven structure severely subsides by a weight of furniture or the like or by walking. This makes it difficult to achieve comfortableness to walk. In addition, if the floor structure sags locally, floor squeaks are liable to occur. In contrast, a nonwoven structure having excessively high apparent density is too hard, so that the nonwoven structure easily propagates vibration. Accordingly, it is difficult to obtain high-frequency floor impact sound insulation.

The basis weight of the nonwoven structure can be selected from the range, for example, about 50 to 10000 g/m$^2$, and is preferably about 100 to 5000 g/m$^2$, and more preferably about 200 to 3000 g/m$^2$ (e.g., about 300 to 2000 g/m$^2$). A nonwoven structure having an excessively small basis weight has a difficulty in the maintenance of hardness. On the other hand, an excessively large basis weight significantly increases the thickness of the web. In a moist-thermal (heat) process, a high-temperature water vapor fails to enter the inside of the web having an excessively large basis weight, and it is difficult to form a structure having a uniform distribution of the melt-bond of the fibers in the thickness direction.

The nonwoven structure (or fiber) may further contain a conventional additive, for example, a stabilizer (e.g., a heat stabilizer such as a copper compound, an ultraviolet absorber, a light stabilizer, or an antioxidant), a dispersing agent, a thickener or a viscosity controlling agent, a particulate (or fine particle), a coloring agent, an antistatic agent, a flame-retardant, a plasticizer, a lubricant, a crystallization speed retardant, a lubricating agent, an antibacterial agent, an insecticide or acaricide, a fungicide, a delustering agent, a thermal storage medium (or agent), a perfume (or a fragrant material), a fluorescent brightener, and a humectant (or a wetting agent). These additives may be used singly or in combination. The additive may adhere on (or may be supported to) a surface of the structure or may be contained in the fiber.

The thickness of the buffer member can also be selected from the range of about 1 to 100 mm (for example, about 2 to 80 mm) according to the site at which the member is used or the species of the member. In order to express the floor impact sound insulation, the thickness of the buffer member is preferably not less than 3 mm and is, for example, about 3 to 60 mm, preferably about 5 to 50 mm, and more preferably about 6 to 40 mm. According to the present invention, the buffer layer having such a thickness expresses a sufficient sound insulation property, secures the strength of the floor, and inhibits subsidence during walking.

The intermediate layer comprising the buffer member is preferably disposed with a clearance (or a gap) left between the intermediate layer and a surface of a wall without close contact. That is, the clearance formed between the end face of the intermediate layer and the surface of the wall can insulate the vibration conveyed (or propagated) from the floor to the wall, thereby improving the sound insulation effect. The clearance between the end face of the intermediate layer and the surface of the wall is not necessarily needed. In terms of the sound insulation property, it is preferable that the clearance be formed. The clearance is, for example, about 2 to 10 mm, preferably about 3 to 9 mm, and more preferably about 4 to 8 mm.

[Floor Backing Member]

The sound insulation floor structure of the present invention may comprise various floor backing members according to the species of the building. The floor backing member may for example be a concrete slab or an autoclaved light-weight concrete in a reinforced concrete (ferro-concrete) building, a wooden floor used in a general timbered house, and others. The floor backing member may further comprise a tatami mat (Japanese rush mat), a plastic board (or plate), a plywood, a wood board (or plate), a paper, a woven fabric or nonwoven fabric sheet, an inorganic board (or plate) (such as a gypsum board (or plate) or a calcium silicate board (or plate)), a metal board (or plate), or the like, laminated on the concrete slab or the wooden floor.

[Floor Finishing Layer]

As the floor finishing layer, a conventional floor finishing member (for example, a conventional floor finishing member used for cover finishing, flooring finishing, soft finishing, or others) is available according to the species of the room.

The floor finishing member for cover finishing may include, for example, a tatami facing, a carpet, a rug, a rug mat, and a footcloth. The floor finishing member for flooring finishing may include a flooring member such as a solid (or natural) wood-series floor finishing member or a plywood-series floor finishing member. The floor finishing member for soft flooring may include a cork board, a soft plastic board, and others. The soft plastic board may be a plastic sheet having a foamed layer (a cushion floor or a padded floor).

Among these floor finishing members, use of the cork board, the carpet, or the tatami facing further improves light-weight impact sound insulation due to the buffering effect of the front side.

In order to improve the sound insulation property, the floor finishing layer is also preferably disposed with a clearance (or a gap) left between the floor finishing layer and a surface of the wall without close contact. The clearance between the floor finishing layer and the surface of the wall is not necessarily needed. In terms of the sound insulation property, it is preferable that the clearance be formed. The clearance is, for example, about 1 to 10 mm, preferably about 2 to 8 mm, and more preferably about 3 to 6 mm. When there is a clearance between the floor finishing layer and the surface of the wall, a skirting board (or a base board) provided in the clearance allows the clearance to be avoided from exposing. The skirting board is preferably provided about 1 to 2 mm away from the end face of the floor finishing layer. Alternatively, a skirting board having a sheet member attached to a bottom thereof (what is called a "finned skirting board"), where the sheet member comprises a synthetic resin or the like, may be used to insulate the vibration conveyed from the floor finishing member to the skirting board or the wall.

The thickness of the floor finishing layer can be selected depending on the species of the floor finishing member. The flooring member may have a thickness of, for example, about 2 to 20 mm, preferably about 3 to 15 mm, and more preferably about 5 to 15 mm. The soft floor finishing member may have a thickness of, for example, about 1 to 20 mm, preferably about 1.5 to 10 mm, and more preferably about 2 to 8 mm.

Hereinafter, the sound insulation floor structure of the present invention will be explained with reference to the drawings according to need. In the following sound insulation floor structures, as a floor backing member and a floor finishing layer, the above-mentioned floor backing member and the above-mentioned floor finishing layer may be used.

[Sound Insulation Floor Structure A]

FIG. 1 is a schematic cross-sectional view of a sound insulation floor structure A in accordance with an embodiment of the present invention. The sound insulation floor structure A has a buffer layer comprising a buffer member as an intermediate layer and comprises, in sequence, a floor backing member 1, a buffer layer 2, an air layer 3, a hard layer 4, and a floor finishing layer 5. A plurality of rod-like support members 6, each having a rectangular cross section, are disposed (or interposed) between the buffer layer 2 and the hard layer 4. These support members 6 are disposed parallel to each other at predetermined intervals. That is, the air layer 3 is formed between adjacent support members 6. FIG. 1 is a cross-sectional view along a direction perpendicular to a long side of the support members 6.

(Buffer Layer)

The buffer layer is disposed in order to improve the absorption of a floor impact sound in the sound insulation floor structure A. The buffer layer, which requires elasticity and shock absorption, comprises the above-mentioned buffer member having a reasonable void ratio and an excellent sound absorption. The sound insulation floor structure A can effectively prevent the generation of impact and reduce the propagation of the impact to downstairs by disposing the buffer layer under a support member partly supported. Further, use of the buffer member comprising (or formed with) the nonwoven structure allows a high-frequency sound wave to be absorbed. This leads to improve the livability of a downstairs room.

In particular, the sound insulation floor structure A comprises the buffer layer as the lowest layer, and the buffer layer is subjected to the load of the whole floor. Since the nonwoven structure comprises the fibers fixed by melt-bonding of the moistenable-thermal adhesive fiber with a high-temperature (superheated or heated) water vapor, the fibers are uniformly bonded in the thickness direction. Thus the nonwoven structure secures a high strength while maintaining the fiber structure.

The sound insulation floor structure A has no joist disposed therein, and the nonwoven structure for forming the buffer member has an apparent density of, for example, about 0.07 to 0.35 g/cm$^3$ and more preferably about 0.1 to 0.3 g/cm$^3$.

In order to express the floor impact sound insulation, the buffer layer has a thickness of, for example, about 3 to 20 mm, preferably about 5 to 18 mm (e.g., about 5 to 15 mm), and more preferably about 8 to 16 mm.

(Air Layer)

The air layer is formed to improve the insulation against a floor impact sound (in particular, a low-frequency impact sound such as a heavy floor impact sound). The air layer is formed by disposing a rod-like support member having a rectangular cross section between the buffer layer and the hard layer at intervals. In order to form a highly sound-insulating space portion, the support member is preferably disposed so that the support member may occupy about 10 to 70%, preferably about 10 to 50%, and more preferably about 10 to 30% of a floor area.

The shape of the support member is not particularly limited to a specific one as far as the support member occupies the above-mentioned area. In terms of workability and others, a rod-like (long) support member having a length corresponding to one side of a room to be provided (or installed) is preferred. The workability and the stability of the floor structure can be improved by disposing a plurality of rod-like support members parallel to each other with a space (particularly, at equal spaces). For example, depending on the size of the room, from the viewpoint of the bonding of the support member and the hard layer, rod-like support members, each being about 10 to 100 mm (particularly about 30 to 75 mm) in width, may be disposed at equal spaces so that the support members can occupy the above-mentioned area. The disposing position of the support members is not particularly limited to a specific one. Uniform distribution of the support members at equal intervals can achieve uniform floor impact sound insulation.

From the viewpoint of workability or stability after installation, it is preferable that the cross-sectional form of the rod-like support member (the form or shape of a cross section perpendicular to the longitudinal direction of the rod-like support member) have parallel sides. For example, the cross-sectional form may include a quadrilateral form (e.g., a square form, a rectangular form, and a trapezoidal form). Use of the rod-like support member having a quadrangular cross section (such as a square form or a rectangular form) prevents the support member from slipping at installation, and allows easy supposition of the position of the support member when the support member is fixed after being covered with the wood board member and the floor finishing member. The rod-like support member having a quadrangular cross section thus facilitates the installation (or construction).

The material to be used of the support member may include an organic material and an inorganic material, as exemplified in the item of the joist. In order to easily hold a nail for fixing the floor finishing layer and the hard layer, a wood material is preferred. The wood material may include a solid wood (or a natural wood), a laminated wood material, a wood fiber material, and others. In terms of the nail-holding property, a laminated wood material or a wood fiber material is preferred. For example, the same board member as the wood board member used for the hard layer (for example, a plywood, a particle board, and an oriented strand board) may be cut to prepare the support member. Further, the support member may be a combination of the wood material, and a nonwoven structure for the buffer layer and/or a damping member for the after-mentioned damping layer.

The support member has a thickness of, for example, about 5 to 20 mm, preferably about 8 to 18 mm, and more preferably about 10 to 15 mm. According to the present invention, the combination of the air layer formed by adjusting the thickness of the support member to this range and the buffer layer formed as a layer lower than the air layer allows a floor impact sound to be insulated effectively. In particular, the air layer having the thickness within this range can effectively block a low-frequency impact sound while maintaining the strength of the floor structure. In contrast, since the thickness of the air layer is relatively small, the air layer acts as an air spring to directly transmit vibration to the floor backing member, thus the floor structure lowers the sound insulation. The influence of air spring, however, can be inhibited by the buffer layer. In addition, the influence of air spring can be relieved by the partly supported structure of the edge joist mentioned below.

(Hard Layer)

The hard layer is disposed in order to impart the mechanical strength to the sound insulation floor structure. The hard layer may be made from (or of) an inorganic material or may be made from (or of) an organic material.

The inorganic material may include, for example, a metal material (for example, aluminum, iron, stainless steel, and steel) and a metal compound material (for example, gypsum, calcium silicate, and glass). These inorganic materials may be used alone or in combination. Among these inorganic materials, the metal material such as iron or aluminum is preferred.

The organic material may include, for example, a wood material [for example, a solid wood, a plywood (a laminated wood board), a wood fiber board (e.g., a medium-density fiber board MDF, a particle board, an oriented strand board, and an insulation board)], a hard fiber sheet (e.g., a heat-set needled felt and a paper board), and a synthetic resin material (for example, a polyethylene, a polypropylene, a polystyrene, a poly(vinyl chloride) resin, a poly(methyl methacrylate), a polyester, a polycarbonate, and a polyamide). These organic materials may be used alone or in combination. Among these organic materials, in term of a balance between light-weight property and strength, or others, the wood material is preferred.

The hard layer may comprise the inorganic material and the organic material in combination. For example, the hard layer may be a composite or laminated surface member comprising an inorganic material and an organic material, such as a vinyl chloride steel plate (a metal plate covered with a poly(vinyl chloride)). Moreover, the hard layer may comprise an inorganic material of which a surface is wholly or partly covered with an elastic layer.

Among these materials, the material to be preferably used includes a wood board, an inorganic board (such as a gypsum board and a calcium silicate board), a plastic board (e.g., a plastic board such as an acrylic board, and a hard foam plastic), a hard fiber sheet (such as a heat-set needled felt or a paper board), or others. In terms of excellent light-weight property or easiness of construction, usually, a wood board is employed. The wood board is not particularly limited to a specific one as far as the wood board is a plate-like or sheet-like wood member. For example, the wood board may include a solid wood, a plywood (a laminated wood board), and a wood fiber board (e.g., an MDF, a particle board, and an oriented strand board). Among them, in terms of a high ability to hold a nail for fixing the floor finishing layer, the preferred one includes a structural plywood, a particle board, an oriented strand board, or the like. The wood board member is usually employed in combination with a plurality of board members. Since a butting site (that is, a joint) in a plane direction of adjacent board members has a weak strength, the board members are preferably disposed so that the butting site may be located on the after-mentioned support member or joist.

In the same manner as the intermediate layer, the hard layer is also preferably disposed with a clearance (or a gap) left between the hard layer and a surface of the wall without close contact. The clearance between the hard layer and the surface of the wall is not necessarily needed. In terms of the sound insulation property, it is preferable that the clearance be formed. The clearance is, for example, about 2 to 10 mm, preferably about 3 to 9 mm, and more preferably about 4 to 8 mm.

The hard layer has a thickness of, for example, about 5 to 20 mm, preferably about 8 to 18 mm, and more preferably about 9 to 15 mm (particularly about 10 to 15 mm).

[Sound Insulation Floor Structure B]

Figure 2:
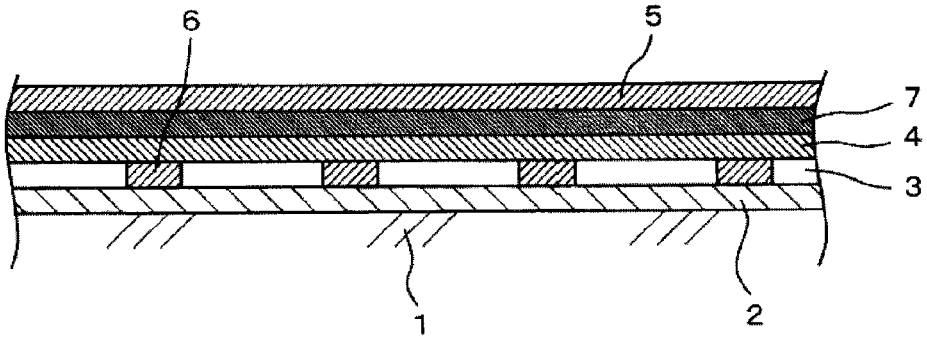
FIG. 2 is a schematic cross-sectional view of a sound insulation floor structure B in accordance with another embodiment of the present invention.

FIG. 2 is a schematic cross-sectional view of a sound insulation floor structure B in accordance with another embodiment of the present invention. The sound insulation floor structure B has a damping layer 7 between the hard layer 4 and the floor finishing layer 5 of the sound insulation floor structure A in order to reduce a vibration derived from a floor impact source by the damping effect and further improve the floor impact sound insulation. Incidentally, FIG. 2 is a cross-sectional view along a direction perpendicular to a long side of the support members 6.

As the buffer layer, the air layer, and the hard layer in the sound insulation floor structure B, the buffer layer, the air layer, and the hard layer as described in the sound insulation floor structure A can be used.

(Damping Layer)

The damping layer is disposed in order to reduce a vibration derived from a floor impact source by the damping effect and improve the floor impact sound insulation. The damping layer is not particularly limited to a specific one as far as the damping layer can block a floor impact sound in a wide range of frequencies. The damping layer may comprise a damping member having a high density and a high specific gravity.

As the damping member, usually, a mixture containing a binder component and a filler is employed. The binder component may include, for example, a bituminous material (such as an asphalt), a synthetic resin, a rubber, and an elastomer. In order that the binder component may show the damping effect, it is usually preferable that the binder component have a mass per unit area of not less than 4 kg/m$^2$. In terms of such a high specific gravity, the binder component preferably contains an asphalt. The asphalt is not particularly limited to a specific one. As the asphalt, there may be used a general asphalt, for example, a petroleum asphalt such as a natural asphalt, a straight asphalt, or a blown asphalt. These asphalts may be used alone or in combination.

Further, in order to impart flexibility to the damping member, the binder component may contain a soft resin or an elastomer component in addition to the asphalt. The soft resin or the elastomer component may include, for example, a polyolefin, a vinyl-series polymer (e.g., a poly(vinyl chloride), an ethylene-vinyl acetate copolymer, an ethylene-vinyl alcohol copolymer, an ethylene-acrylic acid copolymer, an ethylene-methyl acrylate copolymer, and an ethylene-ethyl acrylate copolymer), a polyamide, a polyester, a synthetic rubber (e.g., a polybutadiene, a polyisoprene, and a styrene-butadiene copolymer), a natural rubber, and a rosin-series resin (e.g., a natural rosin and a modified rosin). These soft resins or elastomer components may be used alone or in combination. Among these soft resins or elastomer components, the preferred one includes a styrene-diene series copolymer such as a styrene-butadiene block copolymer.

In the damping member containing the asphalt, the ratio of the soft resin or the elastomer component relative to 100 parts by weight of the asphalt is, for example, about 0 to 100 parts by weight, preferably about 1 to 80 parts by weight, and more preferably about 3 to 50 parts by weight.

The filler may be an organic filler. In terms of a high specific gravity, an inorganic filler is preferred. The inorganic filler may include, for example, a metal particle (powder) (e.g., iron, copper, tin, zinc, nickel, and stainless steel particles), a metal oxide particle (e.g., iron oxide, iron sesquioxide, tri-iron tetroxide, ferrite, tin oxide, zinc oxide, zinc white, copper oxide, and aluminum oxide particles), a metal salt particle (e.g., barium sulfate, calcium sulfate, aluminum sulfate, calcium sulfite, calcium carbonate, calcium bicarbonate, barium carbonate, and magnesium hydroxide particles), and a mineral particle (e.g., a steel slag, a mica, a clay, a talc, a wollastonite, a diatomaceous earth, a silica sand, and a pumice powder).

These inorganic fillers may be used alone or in combination. Among these inorganic fillers, the preferred filler includes an iron particle, a variety of iron oxide particles, a steel slag particle, a calcium (bi)carbonate particle, and the like.

The shape of the inorganic filler may include a particulate shape or a powdery shape, an amorphous shape, a fibrous shape, and the like. The inorganic filler preferably has a particulate shape or a powdery shape. The inorganic filler has an average particle diameter of, for example, not more than 0.5 mm (e.g., about 0.01 to 0.5 mm) and preferably not more than 0.2 mm (e.g., about 0.05 to 0.2 mm). Since use of the finely powdered inorganic filler improves the moldability in producing the damping member and allows a large amount of the inorganic filler to be uniformly dispersed and mixed in the asphalt base material, the damping member can improve in surface density and thermosensitive stability.

The ratio of the inorganic filler relative to 100 parts by weight of the asphalt is, for example, about 100 to 2000 parts by weight, preferably about 200 to 1800 parts by weight, and more preferably about 300 to 1500 parts by weight. When the amount of the inorganic filler is excessively small, the damping and sound-insulating effect of the damping member is deteriorated. In contrast, when the amount of the inorganic filler is excessively large, it is difficult to mold the damping member because of an overall brittleness thereof, and thus the workability is deteriorated. It is preferable that the surface density of the damping member be adjusted to not less than 4.0 kg/m$^2$ (particularly not less than 8.0 kg/m$^2$).

The damping member can be obtained by any method without a specific limitation, for example, by mixing the binder component and the inorganic filler with heating and forming the mixture into a plate-like form. For the addition of the soft resin or the elastomer component, the inorganic filler may be added to a mixture containing the asphalt and the soft resin or the elastomer.

The damping member preferably has a plate-like or a sheet-like shape in terms of workability and the like. For example, the damping member may be amorphous (e.g., semisolid).

The damping layer has a thickness of, for example, about 1 to 20 mm, preferably about 3 to 15 mm, and more preferably about 4 to 12 mm (particularly about 5 to 10 mm). The damping layer has a specific gravity of, for example, about 2.2 to 3.6, preferably about 2.3 to 3.5, and more preferably about 2.5 to 3.4.

[Sound Insulation Floor Structure C]

Figure 3:
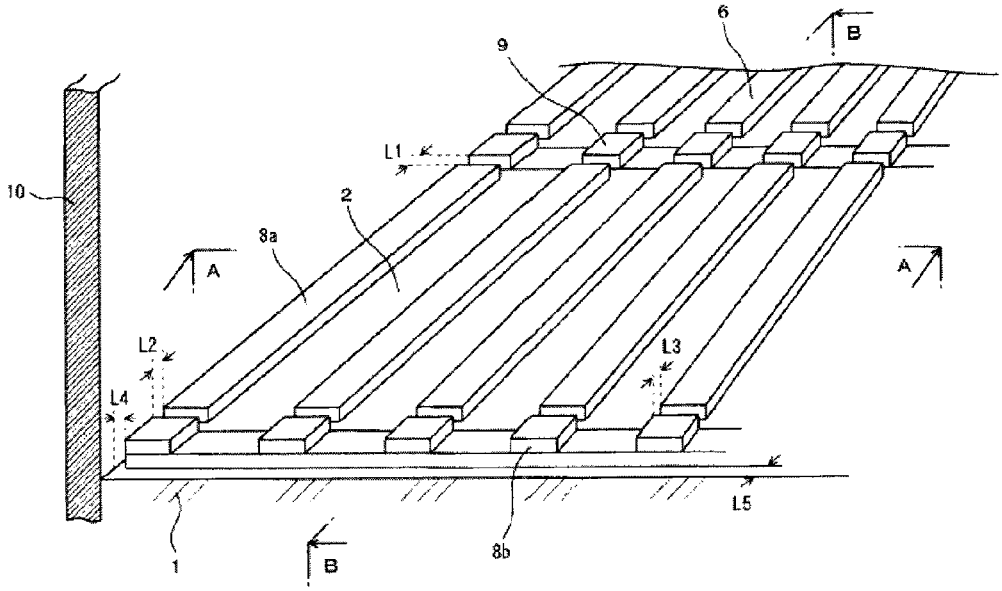
FIG. 3 is a schematic perspective view of a sound insulation floor structure C in accordance with still another embodiment of the present invention.
Figure 4:
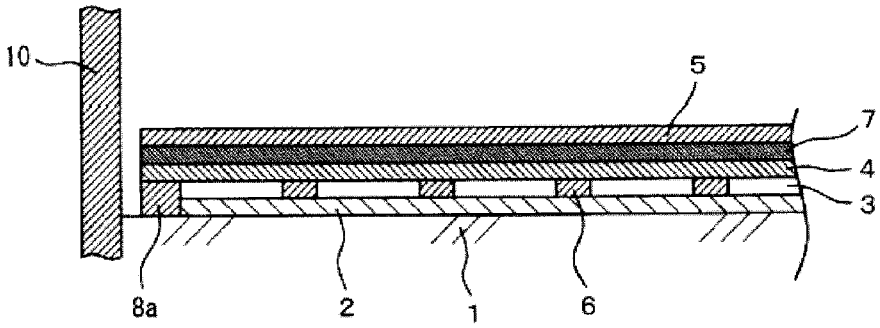
FIG. 4 is a schematic cross-sectional view taken from line A-A of the sound insulation floor structure C of FIG. 3.
Figure 5:
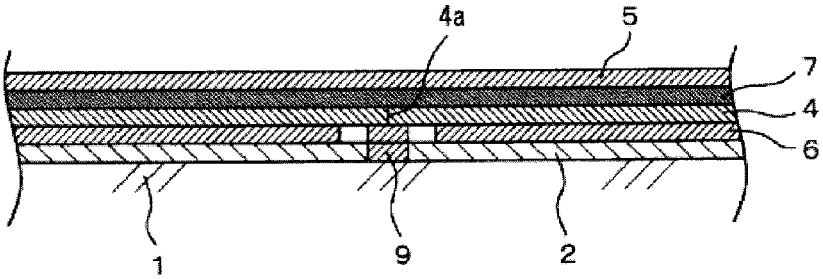
FIG. 5 is a schematic cross-sectional view taken from line B-B of the sound insulation floor structure C of FIG. 3.

FIG. 3 is a schematic perspective view of a sound insulation floor structure C in accordance with still another embodiment of the present invention. FIG. 4 is a schematic cross-sectional view taken from line A-A of the sound insulation floor structure C of FIG. 3. FIG. 5 is a schematic cross-sectional view taken from line B-B of the sound insulation floor structure C of FIG. 3. The sound insulation floor structure C comprises an intermediate layer that is formed with a plurality of joists and buffer layers, and the joists are disposed parallel to each other at intervals. In the intermediate layer, the joists and the buffer layers are disposed alternately, and the buffer layers comprise the buffer member.

Specifically, as shown in FIG. 3, the sound insulation floor structure C comprises, in sequence, a floor backing member 1, a buffer layer 2, an air layer 3, a hard layer 4, a damping layer 7, and a floor finishing layer 5; the buffer layer 2 is disposed between edge joists 8*a*, 8*b* and a joist 9; and a plurality of rod-like support members 6, each having a rectangular cross section, are interposed between the buffer layer 2 and the hard layer 4. These rod-like support members 6 are disposed parallel to each other at intervals. That is, the air layer 3 is formed between adjacent support members 6.

As the air layer, the hard layer, and the damping layer in the sound insulation floor structure C, those as described in the item of the sound insulation floor structures A and B can be used.

In FIG. 3, the hard layer 4, the damping layer 7, and the floor finishing layer 5 are omitted in order to simply explain the arrangement of the edge joists 8*a*, 8*b* and the joist 9. FIG. 4 represents part of the cross section of the floor structure at a wall side. FIG. 5 represents part of the cross section of the floor structure at a central region in which the joist is disposed. In the sound insulation floor structure C, as shown in FIG. 4 and FIG. 5, in order to improve the strength of the floor member, the edge joists 8*a*, 8*b* and the joist 9 are disposed with the buffer layer 2 and the air layer 3 to reinforce the buffer layer 2 and the support member 6 in strength. Specifically, the sound insulation floor structure C comprises the edge joists 8*a* and 8*b* disposed around the floor backing member 1, the joist 9 located in a predetermined region (for example, a central region) of the floor in a direction perpendicular to the long support member 6, the buffer layer 2 disposed between the edge joists 8*a* and 8*b* and the joist 9, and the support member 6 disposed parallel to the edge joist 8*a* at predetermined intervals on the buffer layer 2. The sound insulation floor structure C further has a butting site 4*a* of the edge faces of the hard layers 4 (a joint in adjacent hard layers 4) positioned on the joist 9.

(Joist and Edge Joist)

The edge joist is disposed on all sides of a room and composes an end of the sound insulation floor structure (a site almost contacting with a wall 10). The edge joist 8*a* parallel to the longitudinal direction of the support member 6 is continuously extended toward the joist 9 disposed in the central region to form a structure for supporting the hard layer 4. Whereas, the edge joist 8*b* perpendicular to the longitudinal direction of the support member 6 forms a structure (a partial support structure) in which the edge joint 8*b* supports the hard layer 4 partly at a site corresponding to the support member 6 (a site on an extension of the support member 6). Specifically, the edge joist 8*b* has a plurality of recesses and projections in a direction perpendicular to the longitudinal direction of the support member 6. The recesses, each of which does not correspond to the support member 6, have substantially the same height as the height of the buffer layer 2. In this way, the buffer layer 2 and the support member 6 can be reinforced uniformly in strength by disposing the edge joists 8*a* and 8*b* at the end of the sound insulation floor structure, and thus the subsidence of the floor can be prevented even when a heavy article (such as furniture) is placed on the floor.

In the same manner as the edge joist 8*b*, the joist 9 also supports the hard layer 4 partly at a position corresponding to the support member 6 in a substantially central region of the longitudinal direction of the support member 6. In addition to the edge joists 8*a* and 8*b*, the joist 9 disposed at the central region of a room can reinforce the buffer layer 2 and the support member 6 uniformly in strength, so that the deflection of the floor or the subsidence of the floor caused by walking can be prevented throughout the room. Either the edge joist or the joist may be disposed. It is preferable that at least the edge joist be disposed. The arrangement of the edge joist and the joist can suitably be selected according to a load to be required. A plurality of joists may be disposed, or the joists may be disposed in a direction parallel to the longitudinal direction of the support member. Further, regarding each of the joist and the edge joist, the proportion of the partial support structure is not limited. From the after-mentioned reasons, it is preferable that part of at least the edge joist between the joist and the edge joist have a partial support structure.

The edge joist and the joist (a projection of the edge joist 8*b* and the joist 9) is a rod-like or long form having a rectangular cross section and has the same thickness as the total thickness of the buffer layer 2 and the air layer 3, and is disposed laying across both layers. The compression state of the buffer layer 2 can be adjusted by suitably selecting each thickness of the edge joist and joist (the thickness of the projection of the edge joist 8*b* and the joist 9) within the range from the thickness of the support member 6 to the substantial total thickness of the support member 6 and the buffer layer 2 before installation. Specifically, for example, when each thickness of the edge joist and the joist approximates the thickness of the support member 6, the buffer layer 2 can be compressed; when each thickness of the edge joist and the joist approximates the above-mentioned total thickness, the buffer layer 2 can be in an uncompressed state. Thus the sound insulation characteristic and the strength to be required of the floor structure can be balanced by adjusting the thickness of edge joist and the joist. As the sound insulation floor structures D to F described later, in the buffer layer comprising the nonwoven structure, it is preferable that the strength and stability of the floor structure be increased by adjusting the thickness of edge joist and the joist to a thickness slightly smaller than the substantial total thickness and compressing the buffer layer. In contrast, each thickness of the recess of the edge joist 8*b* and the joist 9 is usually substantially the same as the thickness of the buffer layer 2.

The reason why the edge joist 8*b* and the joist 9 which are disposed perpendicular to the longitudinal direction of the support member 6 (in particular, the edge joist 8*b*) are provided (or installed) so as to form a partial support structure is as follows. That is, when the edge joist is disposed on all sides of a room to shut the air layer tightly, the air layer serves as an air spring to convey a vibration directly to the floor backing member. This leads to deterioration of the sound insulation effect. In contrast, when the edge joist 8*b* and the joist 9 have the partial support structure, air can efficiently be released from the recess, so that the deterioration of the sound insulation property due to the air spring can be inhibited. The edge joist and the joist which are disposed perpendicular to the longitudinal direction of the support member 6 are not limited to the partial support structure. In order to improve the sound insulation effect, it is preferable that at least the edge joist have the partial support structure. The recess is also not particularly limited to a specific size. The size of the recess may be smaller or larger than the size of the corresponding support member. For example, the edge joist and the joist may be disposed at only a site corresponding to (or intersecting) the support member 6 to maximize the area of the recess. In terms of compatibility of the structure strength and the sound insulation property, it is preferred to form a recess having the same size substantially as the size of the corresponding support member.

Further, considering expansion and contraction of the wood material or the like due to temperature and humidity, there are clearances L1, L2, and L3 formed at the butting site of the edge joist 8*a* and the joist 9 (that is, a joint in the edge joist 8 and the joist 9 adjacent thereto), the butting site of the edge joist 8*a* and the edge joist 8*b*, and the butting site of the edge joist 8*b* and the support member 6, respectively. These clearances can prevent generation of sound or the like due to friction between respective members when a load is applied to the floor. The clearances L1 to L3 are not necessarily needed. When provided, these clearances each are, for example, about 1 to 15 mm, preferably about 3 to 13 mm, and more preferably about 5 to 12 mm.

Further, the edge joist 8*a*, the edge joist 8*b*, and the joist 9 are disposed with a clearance left between the joist or edge joist and the wall without close contact. Specifically, there is a clearance L4 between the end face of the edge joist 8*a* in a longitudinal direction thereof and the wall 10, and there is a clearance L5 between the end face of the edge joist 8*b* in a longitudinal direction thereof and a wall (omitted in FIG. 1). The clearances L4 and L5 allow a vibration conveyed from the floor to the wall to be blocked and thus can improve the sound insulation effect. The clearances L4 and L5 are not necessarily needed. When provided, these clearances each are, for example, about 2 to 10 mm, preferably about 3 to 9 mm, and more preferably about 4 to 8 mm.

In terms of workability or stability after installation, it is preferable that the cross-sectional form of each of the edge joist and the joist (a form or shape of a cross section perpendicular to the longitudinal direction thereof) have parallel sides. For example, the cross-sectional form may include a quadrilateral form (e.g., a square form, a rectangular form, and a trapezoidal form). Use of the rod-like joist having a quadrangular cross section (such as a square form or a rectangular form) prevents the support member from slipping at installation, and allows easy supposition of the position of the support member when the support member is fixed after covering with the hard layer (e.g., the wood board member) or the floor finishing member. Thus the rod-like support member having a quadrangular cross section facilitates the installation.

The edge joist and the joist each have a width of, for example, about 10 to 100 mm, preferably about 20 to 90 mm, and more preferably about 30 to 75 mm.

The edge joist has a thickness (maximum thickness) of, for example, about 5 to 50 mm, preferably about 10 to 40 mm, and more preferably about 15 to 35 mm (particularly about 15 to 30 mm). The joist has a thickness of, for example, about 3 to 20 mm, preferably about 5 to 18 mm, and more preferably about 8 to 15 mm.

The material to be used of each of the joist and the edge joist may include the organic material and the inorganic material as exemplified in the hard layer of the above-mentioned sound insulation floor structure A. In terms of a high ability to hold a staple (such as a nail), the preferred material includes a laminated wood material and a wood fiber material, and particularly preferred material includes a structural plywood, a particle board, an oriented strand board. In particular, a board member used for the hard layer (for example, a plywood, a particle board, and an oriented strand board) may be cut to prepare the joist. Further, in order to prevent the transfer of a vibration from the joist, an elastic layer (such as a rubber cushion or a rubber vibration isolator) may be laminated on the whole or part of an upper face and/or a lower face of the joist formed by the wood material.

(Buffer Layer)

The sound insulation floor structure C has the buffer layer as the lowest layer, while the buffer layer is disposed between the edge joist 8*b* and the joist 9. Thus, compared with the sound insulation floor structures A and B, the sound insulation floor structure C can achieve higher-degree sound insulation property by lowering the apparent density of the buffer member. The nonwoven structure for forming the buffer member has an apparent density of, for example, about 0.03 to 0.2 g/cm$^3$ (for example, about 0.03 to 0.15 g/cm$^3$), preferably about 0.04 to 0.18 g/cm$^3$, and more preferably about 0.05 to 0.15 g/cm$^3$. The thickness of the buffer layer can be selected from the same range as the range of the thickness of the sound insulation floor structure A.

In the sound insulation floor structure C, the damping layer is not an essential component. The damping layer is not necessarily disposed when the damping property in a wide range of frequencies is not required. If the damping layer is disposed, it is sufficient that the damping layer is interposed between the floor finishing layer and the floor backing member, but not limited to between the hard layer and the floor finishing layer. A floor impact sound can effectively be diminished by disposing the damping layer, having a sound insulation effect in wide range of frequencies including a heavy floor impact sound, close to a floor. Further, the remaining impact sound is absorbed by the air layer and the buffer layer, each disposed in the underside, so that a more effective sound insulation performance can be achieved. Furthermore, when the floor backing member is a backing member having a poor sound insulation (such as a wooden floor or a light-weight foamed concrete), the floor impact sound insulation may be improved by a plurality of buffer layers and damping layer(s) interposed therebetween.

[Sound Insulation Floor Structure D]

Figure 6:
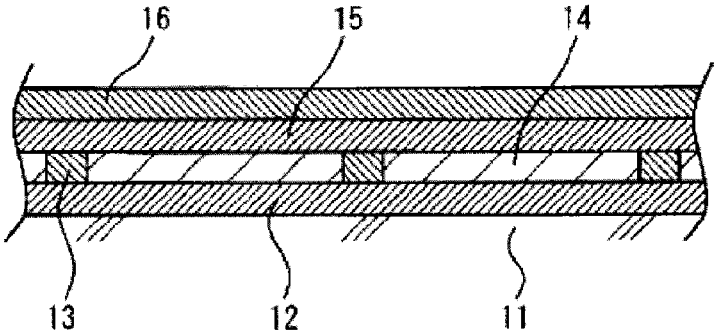
FIG. 6 is a schematic cross-sectional view of a sound insulation floor structure D in accordance with a further embodiment of the present invention.

FIG. 6 is a schematic cross-sectional view of a sound insulation floor structure D in accordance with a further embodiment of the present invention. The sound insulation floor structure D comprises, in sequence, a floor backing member 11, a first hard layer 12, a joist 13, a second hard layer 15, and a floor finishing layer 16; the joists 13, each having a rectangular cross section, are disposed parallel to each other at intervals, a buffer layer 14 is disposed or interposed between the adjacent joists 13, and the buffer layers and the joists are disposed alternately and adjacently. FIG. 6 is a cross-sectional view along a direction perpendicular to a long side of the joist 13.

(First Hard Layer)

The first hard layer is disposed in order to impart the mechanical strength to the sound insulation floor structure, as with the hard layer of the sound insulation floor structure A. As with the hard layer of the sound insulation floor structure A, the first hard layer to be used may include a hard wood board, an inorganic board, and a plastic board, usually a wood board. As with the hard layer of the sound insulation floor structure A, the hard layer is preferably disposed so that the butting site may be located on the joist. The hard layer is also preferably disposed with a clearance (or a gap) between the hard layer and a surface of a wall. The thickness of the first hard layer can also be selected from the same range as that of the hard layer of the sound insulation floor structure A.

(Joist)

The joist is disposed in order to install the buffer layer for improving the sound insulation. As the joists, rod-like members, each having a rectangular cross section, are disposed parallel to each other with a space on the first hard layer. The joists preferably occupy a predetermined area of a floor area in order to improve the sound insulation of the buffer layers. The joists and the buffer layers (compressable layers) have an area ratio (area ratio in the floor area) of, for example, about 3/97 to 50/50, preferably about 5/95 to 40/60, and more preferably about 10/90 to 30/70 (particularly about 15/85 to 20/80) in a ratio of the joists/the buffer layers (compressable layers).

Each of the joists is not particularly limited to a specific shape as far as the joists occupy the above-mentioned area. In terms of workability and the like, the joist preferably includes a rod-like (long) joist having a length corresponding to one side of a room to be provided (or installed). The arrangement of a plurality of rod-like joists parallel to each other at intervals (particularly, at equal spaces) allows excellent workability and improved stability of the floor structure. For example, depending on the size of the room, from the viewpoint of the bonding of the joist and the hard layer, rod-like support joists, each being about 10 to 100 mm (particularly about 30 to 75 mm) in width, may be disposed at equal spaces to occupy the above-mentioned area. The position to be disposed of the joists is not particularly limited to a specific one. Uniform distribution of the joists at equal intervals allows floor impact sound insulation to be uniform.

The cross-sectional form of the joist and the material thereof may be the same as those of the joist of the sound insulation floor structure C described above.

The joist (each one of the joists) has a thickness of, for example, about 5 to 20 mm, preferably about 6 to 18 mm, and more preferably about 7 to 15 mm (particularly about 8 to 12 mm). In the present invention, a floor impact sound can effectively be blocked by disposing the joist having a thickness within this range for installing the buffer layer.

(Buffer Layer)

In the sound insulation floor structure D, the buffer layer is formed with the buffer member and disposed to improve the vibration insulation of a floor impact sound. The compressable layer which comprises a nonwoven structure having an apparent density described in the paragraph of the sound insulation floor structure C is compressed to a thickness of the joist. Since the sound insulation floor structure D achieves an excellent floor impact absorption by disposing the compressable layer in a compressed state as the buffer layer in the sound insulation floor structure, the floor structure can effectively prevent the generation of impact and can reduce the propagation of the impact to downstairs. Thus the floor structure can improve the livability of a downstairs room. Further, the buffer layer can also improve the strength and stability of the floor structure.

The buffer layer may for example be compressed to a thickness to not more than about 0.95 times, preferably about 0.5 to 0.95 times, and more preferably about 0.6 to 0.9 times (particularly about 0.7 to 0.8 times) as large as the thickness thereof before compression (or the thickness of the compressable layer).

The thickness of the buffer layer before compression (the compressable layer) is preferably not less than 3 mm in order to express the floor impact sound insulation. In terms of securement of the floor strength, inhibition of subsidence during walking, as well as advantage of buffering property, easiness of construction, and economical efficiency, the buffer layer before compression may have a thickness of, for example, about 3 to 60 mm, preferably about 5 to 50 mm, and more preferably about 6 to 30 mm (particularly about 8 to 20 mm).

(Second Hard Layer)

The second hard layer is also disposed in order to impart the mechanical strength to the sound insulation floor structure, as with the first hard layer. As the second hard layer, the same board member as the first hard layer is usually employed. According to the purpose, the board member as the second hard layer may be different in species from that of the first hard layer. As with the first hard layer, the second hard layer is preferably disposed so that the butting site may be located on the joist. The second hard layer is also preferably disposed with a clearance (or gap) between the second hard layer and a surface of a wall. The thickness of the second hard layer can also be selected from the same range as that of the first hard layer and is usually the same as the thickness of the first hard layer. According to the purpose, the second hard layer may be different in thickness from the first hard layer.

In the sound insulation floor structure D, it is sufficient that the buffer layers, which are compressed, are interposed between the floor backing member and the floor finishing layer and that the buffer layers and the joists are alternately disposed parallel to each other. The first and second hard layers are not essential components. Thus the sound insulation floor structure D may for example be the following embodiments: an embodiment in which the joists and the buffer layers are disposed on the floor backing member and the hard layer is disposed on the joists and the buffer layers; an embodiment in which the joists and the buffer layers are disposed on the first hard layer and the floor finishing layer is disposed on the joists and the buffer layers; an embodiment in which the joists and the buffer layers are disposed on the floor backing member and the floor finishing layer is disposed on the joists and the buffer layers; and an embodiment in which a damping layer may be interposed as described below in each of the above embodiments. Among these embodiments, an embodiment in which at least one of the first and second hard layers is disposed is widely used.

The sound insulation floor structure D may further comprise a damping layer in order to reduce a vibration from a floor impact source by the damping effect and to further improve the floor impact sound insulation. It is sufficient that the damping layer is disposed between the floor backing member and the floor finishing layer. For example, the damping layer may be disposed between the first hard layer and an arrangement of the joist and the compressable layer, between the first hard layer and the floor backing member, between the second hard layer and an arrangement of the joist and the compressable layer, or between the second hard layer and the floor finishing layer. When the damping layer is disposed between the first hard layer and the floor backing member, another hard layer may further be disposed between the damping layer and the floor backing member. When the damping layer is disposed between the second hard layer and the floor finishing layer, another hard layer may further be disposed between the damping layer and the floor finishing layer. As the damping layer, the same damping layer as that of the sound insulation floor structure B described above can be used.

[Sound Insulation Floor Structure E]

Figure 7:
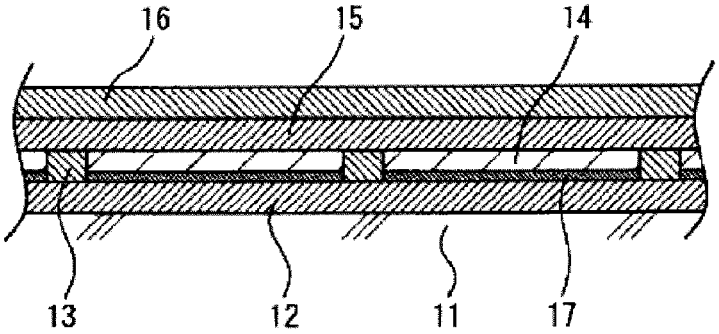
FIG. 7 is a schematic cross-sectional view of a sound insulation floor structure E in accordance with a still further embodiment of the present invention.

FIG. 7 is a schematic cross-sectional view of a sound insulation floor structure E in accordance with a still further embodiment of the present invention. The sound insulation floor structure E is different from the sound insulation floor structure D in the respect that a non-buffer layer 17 and a buffer layer 14, which are laminated in sequence, are disposed or interposed between adjacent joists 13. The combination of the non-buffer layer and the buffer layer allows a sound insulation characteristic different from that of the buffer layer to be imparted to the floor structure. FIG. 7 is also a cross-sectional view along a direction perpendicular to a long side of the joist 13.

As the first hard layer, the joist, the buffer layer, and the second hard layer in the sound insulation floor structure E, the same first hard layer, joist, buffer layer, and second hard layer as those described in the item of the sound insulation floor structure D can be used.

(Non-Buffer Layer)

The material to be used of the non-buffer layer may include the organic material and the inorganic material described in the item of the joist, as well as the damping member described in the item of the damping layer of the sound insulation floor structure B. In order to impart the function (such as thermal insulation) to the floor structure, the non-buffer layer may preferably include a wood board (such as an insulation board), a hard fiber sheet, a damping member, and the like. These members (or materials) may be used alone or in combination. Among these members (or materials), a damping member is particularly preferred. The non-buffer layer comprising the damping member and serving as a damping layer can reduce a vibration from a floor impact source by the damping effect and achieve an improved floor impact sound insulation.

The non-buffer layer has a thickness of, for example, about 1 to 20 mm, preferably about 1.5 to 15 mm, and more preferably about 2 to 10 mm (particularly about 3 to 8 mm). The thickness of the buffer layer may be equal to a thickness obtained by subtracting the thickness of the non-buffer layer from the thickness of the buffer layer described in the item of the sound insulation floor structure D.

[Sound Insulation Floor Structure F]

Figure 8:
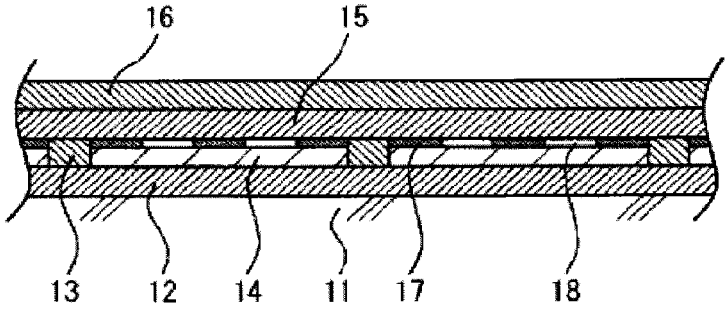
FIG. 8 is a schematic cross-sectional view of a sound insulation floor structure F in accordance with another embodiment of the present invention.

FIG. 8 is a schematic cross-sectional view of a sound insulation floor structure F in accordance with another embodiment of the present invention. The sound insulation floor structure F is different from the sound insulation floor structure D in the respect that a buffer layer 14 and a non-buffer layer 17, which has a space portion 18, are disposed or interposed (or laminated) in sequence between adjacent joists 13. The non-buffer layer and the space portion, each provided in parallel with the joists and disposed on the buffer layer, can achieve absorption of high-frequency sound wave, in addition to the sound insulation effect of the non-buffer layer.

As the first hard layer, the joist(s), the buffer layer(s), the non-buffer layer(s), and the second hard layer in the sound insulation floor structure F, the same first hard layer, joist, buffer layer, non-buffer layer, and second hard layer as those described in the items of the sound insulation floor structures D and E can be used.

(Space Portion)

The space portion 18 is formed by disposing long non-buffer layers 17, each extending parallel to the longitudinal direction of the joist 13, at intervals on the buffer layer 14. The space portion 18 is not particularly limited to a specific one as far as the space portion is formed at a predetermined area in a floor area. For example, the long non-buffer layers may be disposed at intervals in the direction perpendicular to the longitudinal direction of the joist. The area that the space portion occupies is, for example, about 1 to 90%, preferably about 5 to 80%, and more preferably about 10 to 70% of the whole area of the buffer layer.

The sound insulation floor structures E and F are not particularly limited to the above-mentioned embodiments. In the embodiment of FIG. 7, the non-buffer layer may have a space portion. In the embodiment of FIG. 8, the non-buffer layer may not have a space portion. Further, when the floor backing member is a backing member having a poor sound insulation (such as a wooden floor or a light-weight foamed concrete), the floor impact sound insulation may be improved by a plurality of buffer layers and the non-buffer layer(s) interposed therebetween.

[Sound Insulation Floor Structures G to I]

Each one of the sound insulation floor structures G to I has the same structure as that of each one of the sound insulation floor structures D to F and is characterized in that the joist comprises a buffer member. In the sound insulation floor structures G to I, as the floor backing member, the first hard layer, the non-buffer layer, the second hard layer, and the floor finishing layer, the same floor backing member, first hard layer, non-buffer layer, second hard layer, and floor finishing layer as those described in the sound insulation floor structures A to D can be used.

(Joist)

The buffer member for the joist preferably has a density higher than that of the buffer member for the buffer layer in terms of prevention of subsidence. For example, the buffer member for the joist has a density of, for example, about 0.07 to 0.35 g/cm$^3$ and preferably about 0.1 to 0.3 g/cm$^3$.

The joist may comprise a buffer member alone or may comprise combination of a buffer member and another material (or another member), for example, the material described in the item of the joist of the sound insulation floor structure C. The buffer member and another material may form, for example, a two-layer structure. The thickness ratio of the layer of the buffer member relative to the layer of another material is about 10/1 to 1/10, preferably about 3/1 to 1/5, and more preferably about 2/1 to 1/3 (particularly about 1/1 to 1/2) as a ratio of the former/the latter.

The cross-sectional form and the thickness of the joist may be the same as those described in the item of the joist of the sound insulation floor structure D.

(Buffer Layer)

The buffer layer is not particularly limited to a specific one as far as the buffer layer comprises the buffer member and/or a plate-like or sheet-like member having elasticity and shock absorption. As the plate-like or sheet-like member, there may be used a foam plastic (for example, a styrene foam, a urethane foam, and a polyolefin foam), a rubber or an elastomer, a fiber structure (a structure comprising a woven or knitted fabric, a nonwoven fabric, or the like), and the like. Among them, a nonwoven structure is preferred due to a reasonable void ratio and an excellent sound absorption property thereof.

The nonwoven structure may include, for example, a nonwoven structure for forming the buffer member, and a formed product in which a nonwoven fabric is fixed by a mechanical compression treatment (e.g., needle punch), a partial thermo-compression fusing treatment (e.g., thermal embossing), or a bonding or fusing treatment through a binder component. The fiber for the nonwoven fabric may include, for example, a polyolefin-series fiber, a (meth)acrylic fiber, a polyvinyl alcohol-series fiber, a vinyl chloride-series fiber, a styrene-series fiber, a polyester-series fiber, a polyamide-series fiber, a polycarbonate-series fiber, and a polyurethane-series fiber. Among these fibers, a polyester-series fiber, a polyamide-series fiber, or a conjugated fiber containing these fibers, or the like is widely used.

As the polyester-series resin for the polyester-series fiber, an aromatic polyester-series resin such as a poly($C_{2-4}$alkylene arylate)-series resin [such as a poly(ethylene terephthalate) (PET), a poly(trimethylene terephthalate), a poly(butylene terephthalate), or a poly(ethylene naphthalate)], in particular, a poly(ethylene terephthalate)-series resin (such as a PET) is preferred. The poly(ethylene terephthalate)-series resin may comprise an ethylene terephthalate unit and an additional constitutional unit composed of another dicarboxylic acid (for example, isophthalic acid, naphthalene-2,6-dicarboxylic acid, phthalic acid, 4,4'-diphenyldicarboxylic acid, bis(carboxyphenyl)ethane, and 5-sodiumsulfoisophthalic acid) or another diol (for example, diethylene glycol, 1,3-propanediol, 1,4-butanediol, 1,6-hexanediol, neopentyl glycol, cyclohexane-1,4-dimethanol, a poly(ethylene glycol), and a poly(tetramethylene glycol)); the proportion of the additional constitutional unit may be about not more than 20 mol %.

The polyamide-series resin for the polyamide-series fiber may preferably include an aliphatic polyamide (such as a polyamide 6, a polyamide 66, a polyamide 610, a polyamide 10, a polyamide 12, or a polyamide 6-12) and a copolymer thereof, a semi-aromatic polyamide synthesized from an aromatic dicarboxylic acid and an aliphatic diamine, and others. These polyamide-series resins may contain other copolymerizable units.

In the present invention, particularly, among the nonwoven structures, a nonwoven structure for forming the buffer member, a structure having a structure fixed by melting of the binder component (in particular, a binder fiber comprising a thermal adhesive fiber containing a thermal adhesive resin such as a polyester-series, a polyamide-series, a polyolefin-series, or a polyvinyl alcohol-series resin) is preferred.

Since the sound insulation floor structure of the present invention achieves comfortable to walk and has not only a high insulation against a floor impact sound but also a moderate and uniform hardness, the sound insulation floor structure has an excellent safety in falling down. Specifically, the sound insulation floor structure of the present invention has a hardness (impact acceleration G value) of not more than 100 G in accordance with JIS (Japanese Industrial Standards) A6519. For example, the floor structure has a hardness of about 10 to 100 G, preferably about 20 to 90 G, and more preferably about 30 to 85 G (particularly about 40 to 80 G).

Further, the ordinary floor structure is soft in an area over (or corresponding to) a region between beams and in an area over a region between joists, while hard in an area over the beam or the joist. In particular, there is a tendency that the ordinary floor structure has the hardest area over a region where the beam overlaps with the joist. In contrast, for the sound insulation floor structure of the present invention, the ratio of the acceleration G value in the hardest area relative to that in the softest area is, for example, not more than 1.3, preferably not more than 1.2, and more preferably not more than 1.1 (particularly not more than 1.05). Irrespective of the position in the floor, the acceleration G value is substantially uniform (the ratio is about 1 to 1.01). Accordingly, the floor structure is uniformly comfortable to step on and achieves stable comfortableness to walk. Further, since there is no locally hard area, the floor structure hardly injures a person if the person falls down. Thus the floor structure has a high safety.

[Process for Installing or Producing Sound Insulation Floor Structure]

The sound insulation floor structure of the present invention can be installed (or constructed) by laminating a joist, a buffer layer, a hard layer, a damping layer, a support member, a hard layer, a floor finishing layer, or others in sequence on a floor backing member, according to the layer structure thereof.

First, in the case where the joist (or edge joist) is disposed, a buffer member (or another nonwoven structure, or the like) for the buffer layer is laid (or bedded) between the joists after installation of each one of the joists. The joist may be fixed (or fastened) with an adhesive or a pressure sensitive adhesive, a fixing means (or a clamp or a brace), and the like.

The adhesive or the pressure sensitive adhesive can be selected from commonly used adhesives or pressure sensitive adhesives depending on the material for the buffer member or that for the joist. The adhesive may include a natural polymer adhesive (such as a starch or a casein), a thermoplastic resin adhesive [for example, a vinyl-series adhesive (such as a poly(vinyl acetate)), an acrylic adhesive, a polyester-series adhesive, and a polyamide-series adhesive], a thermosetting resin adhesive (such as an epoxy resin), and others. Examples of the pressure sensitive adhesive may include a rubber pressure sensitive adhesive and a thermoplastic resin pressure sensitive adhesive (such as an acrylic pressure sensitive adhesive).

The fixing means may include an engagement means (e.g., a nail, a screw, a spike, a staple, and a needle), an adhesive tape, a hook-and-loop fastener, and the like.

Among them, usually the method of using the fixing means (such as a nail or a spike) is widely used.

For the partial support structure in the joist and the edge joist of the sound insulation floor structure C, a joist and an edge joist, each having an uneven structure (or having a recess and a projection) may use used. Alternatively, a first member (such as a wood material) having a thickness equivalent to a recess may be installed before installing a second member equivalent to a projection on the first member. The first and second members are usually fixed (or fastened) with, for example, an adhesive or an adhesive tape.

As described above, the joist is preferably disposed so that there may be no region where the joist overlaps with the beam. For example, when the joist is disposed in a direction perpendicular to the beam, there is inevitably a region where the joist overlaps with the beam at an intersection. Accordingly, it is preferable that the joist be disposed parallel to the beam and be not located at an area over (or corresponding to) the beam (that is, the beam be located in an area over a region between adjacent joists).

In a layer having the joists, the buffer member (a buffer layer or a compressable layer) is laid (or bedded) between the joists. In this case, the buffer member may be laid after applying the adhesive or the pressure sensitive adhesive on a foundation (such as a floor backing member or a first hard layer), or the buffer member may be laid and then fixed with the fixing means or the like. Further, together with the buffer member, a non-buffer layer may be disposed in the upper or lower side of the buffer member. It is sufficient that the buffer member is disposed between adjacent joists. The buffer member may be laid to leave (or form) a moderate clearance. In order to improve the vibration insulation, the buffer members and the joists are preferably disposed alternately and adjacently.

Except for the sound insulation floor structure C, the joist may be disposed after laying the buffer member or the first hard layer on the floor backing member.

As the first hard layer, a plurality of wood boards are usually employed. The wood boards are preferably disposed so that the joist may be located on the butting site (a joint in adjacent wood boards). When the wood boards are disposed so that the joist may be located on the butting site, the hard layer has an improved stability. Thus the subsidence caused by loading at the butting site of the wood boards can be prevented. The butting site of the wood boards may be allowed to closely contact with each other. In consideration of expansion and contraction of the wood boards due to temperature and humidity, the wood boards may be disposed to give a clearance of about 1 to 20 mm (particularly about 5 to 15 mm).

Secondly, in the sound insulation floor structures A to C, the support members are disposed at intervals on the buffer member to give an air layer. The support member and the buffer member may be fixed (or fastened) with the above-mentioned adhesive (or pressure sensitive adhesive) or the above-mentioned fixing means. Among them, loose or free installation or an adhesive or a double-faced adhesive tape is preferably used. Then a wood board or the like is disposed on the support member to give a hard layer. A plurality of the wood boards are usually employed as the hard layer. In this case, the wood boards (a joint in adjacent wood boards) are preferably disposed so that the butting site (a joint in adjacent wood boards) may be located on the support member or the joist in the light of the stability of the hard layer.

Each one of the sound insulation floor structures D to I comprise a second hard layer formed on the joist and the compressable layer. As with the first hard layer, wood boards as the second hard layer are preferably disposed so that the butting side of the wood boards may be located on the joist. The compressable layer is sandwiched between the first hard layer and the second hard layer by laminating the second hard layer and the joist in contact with each other and compressed to a thickness of the joist to form a buffer layer.

Finally, a floor finishing member is disposed on the hard layer to form a floor finishing layer. The hard layer and the floor finishing layer may also be fixed (or fastened) with the above-mentioned adhesive (or pressure sensitive adhesive) or the above-mentioned fixing means. The floor finishing member and the hard layer are both hard and usually fixed by an engagement means (such as a nail, a staple, or a spike). In order to improve the sound insulation, the engagement means to be used preferably has a length which does not reach the buffer layer. For example, when the floor finishing member is a flooring member (a wooden floor), the engagement means to be used is usually a nail, designated as a floor nail. If the floor nail reaches the buffer layer or the floor backing member, there is a possibility that the floor impact sound insulation is lowered due to sound bridge. Accordingly, when the joist or the support member comprises a material having a nail-holding property (for example, a wood material), the engagement means (e.g., a floor nail) is preferably used to join from the floor finishing layer to the joist or the support member. The joining from the floor finishing layer to the joist or the support member improves the stiffness of the floor itself. Thus the floor not only has an improved floor impact sound insulation but also is more comfortable to walk.

When the damping layer is disposed between the floor finishing layer and the floor backing member, it is preferable that the damping member be fixed to each of the floor backing member, the floor finishing member, the hard layer, and the joist and the buffer layer with an adhesive or a pressure sensitive adhesive. The fixation of these members with the adhesive can improve the stiffness of the floor itself and the floor impact sound insulation. Moreover, when the buffer layer as the compressable layer and the damping layer as the non-buffer layer are used together, it is preferable that these layers be fixed with an adhesive or a pressure sensitive adhesive in the same way.

When a floor heating system is installed, a floor heating panel may be disposed just under the floor finishing member. When the damping member is used, it is preferable that a wooden panel or a heat-insulating panel be further disposed on the damping member.

The sound insulation floor structure of the present invention may be installed in part of a room without limitation to an embodiment in which the floor structure is installed in the whole area of a room. For example, a room with a heavy load (such as a piano) may partially secure a strength by an embodiment in which the joist or the support member is laid in a substantially whole area of an region where the heavy load is placed, an embodiment in which the buffer layer or the air layer is replaced with a wood board having a high load capacity, or other embodiments.

[Sound Insulation Floor Component]

The sound insulation floor component of the present invention is used for forming the sound insulation floor structures D to I. It is sufficient that the floor component comprises a plurality of joists to be disposed parallel to each other at intervals and a plurality of compressable layers, each having a thickness larger than a thickness of each one of the joists, and that the joists and the compressable layers are disposed alternately.

When the joists and the compressable layers in the sound insulation floor component are fixed on one side of a hard layer (a first hard layer) beforehand, it is not necessary to set up any joists at a construction site. This allows easy installation of the floor component and prevention of deterioration in the quality depending on varied installation.

Figure 9:
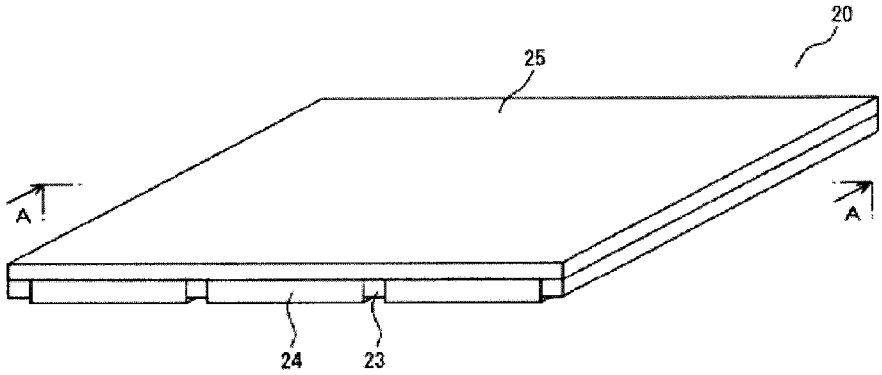
FIG. 9 is a schematic perspective view of a sound insulation floor component in accordance with an embodiment of the present invention.
Figure 10:
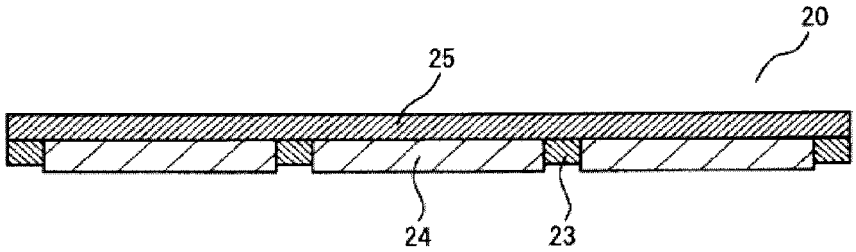
FIG. 10 is a schematic cross-sectional view taken from line A-A of the sound insulation floor component of FIG. 9.

FIG. 9 is a schematic perspective view of a sound insulation floor component in accordance with an embodiment of the present invention. FIG. 10 is a schematic cross-sectional view taken from line A-A of the sound insulation floor component of FIG. 9. In order to improve the easiness of construction, a sound insulation floor component 20 in accordance with an embodiment of the present invention comprises, as shown in FIG. 9 and FIG. 10, a first hard layer 25, joists 23 disposed parallel to each other with a space and fixed on the hard layer 25, and compressable layers 24, each disposed between adjacent joists and fixed on the hard layer 25. The joists 23 and the compressable layers 24 each are fixed on the hard layer 25 with an adhesive (or a pressure sensitive adhesive). In the component, each one of the compressable layers is compressed by a floor backing member or a floor finishing layer at a construction site to form a buffer layer.

The compressable layer (a buffer layer before compression) has a thickness of not less than 1.05 times [for example, about 1.05 to 3 times, preferably about 1.1 to 2 times, and more preferably about 1.2 to 1.5 times (particularly, about 1.3 to 1.4 times)] as large as the thickness of the joist. When the compressable layer comprises a buffer layer and a non-buffer layer, the layer to be compressed (the buffer layer before compression) has a thickness of not less than 1.05 times [for example, about 1.05 to 5 times, preferably about 1.1 to 4 times, and more preferably about 1.3 to 3 times (particularly, about 1.5 to 2 times)] as large as a thickness obtained by subtracting the thickness of the non-buffer layer from the thickness of the joist.

Figure 11:
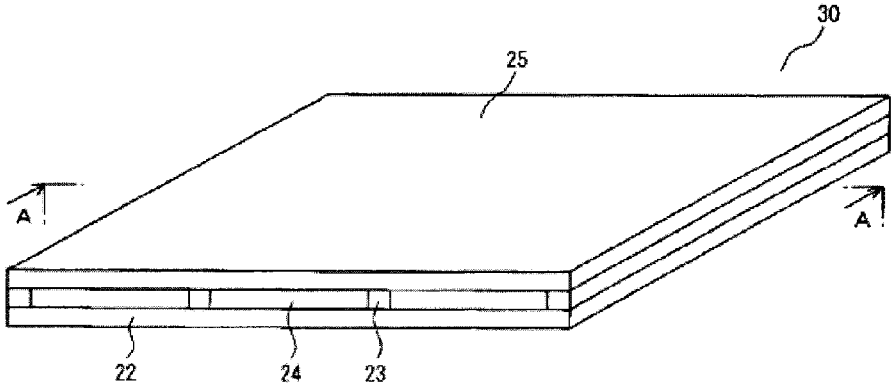
FIG. 11 is a schematic perspective view of a sound insulation floor component in accordance with another embodiment of the present invention.
Figure 12:
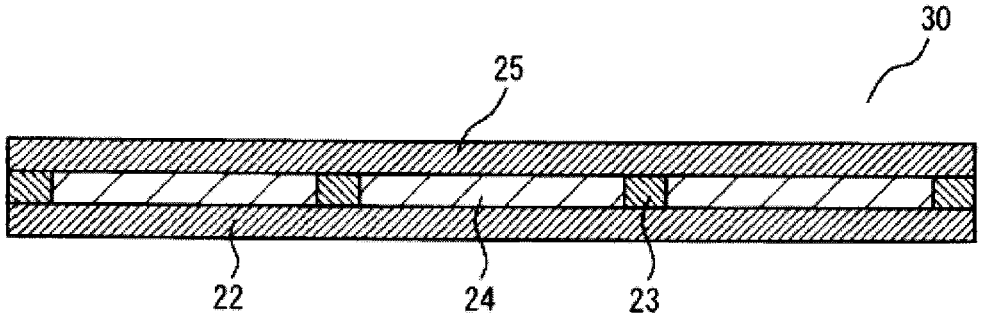
FIG. 12 is a schematic cross-sectional view taken from line A-A of the sound insulation floor component of FIG. 11.

The sound insulation floor component of the present invention may comprise a further hard layer (a second hard layer) fixed on the joist and the compressable layer which are fixed on one side of the first hard layer. FIG. 11 is a schematic perspective view of a sound insulation floor component in accordance with another embodiment of the present invention. FIG. 12 is a schematic cross-sectional view taken from line A-A of the sound insulation floor component of FIG. 11. In order to further improve the easiness of construction, a sound insulation floor component 30 comprises, as shown in FIGS. 11 and 12, a hard layer (a second hard layer) 22 disposed on the compressable layers 24 and the joists 23 of the sound insulation floor component shown in FIG. 9; and each one of the compressable layers 24 is compressed to a thickness of each one of the joists 23 and fixed to the hard layer 22. In the component, since the compressable layer is compressed to form a buffer layer, it is sufficient to simply cut according to need and dispose the sound insulation floor component for installation at a construction site.

In the sound insulation floor component of the present invention, a damping member may further be fixed between the hard layer and the joist or on a surface of the hard layer.

In the sound insulation floor component of the present invention, the hard layer, the joist and the compressable layer, and the damping member may mutually be fixed (or bonded or joined) by any means without limitation to an adhesive (or a pressure sensitive adhesive). The means for fixation may include a fixing means, a combination of the adhesive and the fixing means, and the like. From the aspect of easy construction (e.g., easy cutting of the floor component at a construction site), the adhesive (or the pressure sensitive adhesive) is preferable as the means for fixation.

EXAMPLES

Hereinafter, the following examples are intended to describe this invention in further detail and should by no means be interpreted as defining the scope of the invention. The values of physical properties in Examples were measured by the following methods. The terms "part" and "%" in Examples are by mass unless otherwise indicated.

(1) Basis Weight (g/m$^2$)

In accordance with JIS L1913 "Test methods for nonwovens made of staple fibers", the basic weight was measured.

(2) Thickness (mm) and Apparent Density (g/cm$^3$)

In accordance with JIS L1913 "Test methods for nonwovens made of staple fibers", the thickness of the nonwoven structure was measured, and the apparent density was calculated using the obtained thickness and weight of the nonwoven structure.

(3) Bonded Fiber Ratio

The bonded fiber ratio was obtained by the following method: taking a macrophotography of the cross section with respect to the thickness direction of a structure (100 magnifications) with the use of a scanning electron microscope (SEM); dividing the obtained macrophotography in a direction perpendicular to the thickness direction equally into three; and in each of the three area [a surface area, an central (middle) area, a backside area], calculating the proportion (%) of the number of the cross sections of two or more fibers melt-bonded to each other relative to the total number of the cross sections of the fibers (end sections of the fibers) by the formula mentioned below. Incidentally, in the contact part or area of the fibers, the fibers just contact with each other or are melt-bonded. The fibers which just contacted with each other disassembled at the cross section of the structure due to the stress of each fiber after cutting the structure for taking the microphotography of the cross section. Accordingly, in the microphotography of the cross section, the fibers which still contacted with each other was determined as being bonded.

Bonded fiber ratio (%)=(the number of the cross sections of the fibers in which two or more fibers are bonded)/(the total number of the cross sections of the fibers)×100;

providing that in each microphotography, all cross sections of the fibers were counted, and when the total number of the cross sections of the fibers was not more than 100, the observation was repeated with respect to macrophotographies which was taken additionally until the total number of the cross sections of the fibers became over 100. Incidentally, the bonded fiber ratio of each area was calculated, and the ratio of the minimum value relative to the maximum value (the minimum value/the maximum value) was also calculated.

(4) Sound Insulation Characteristic of Floor Impact Sound

The sound insulation characteristic of floor impact sound was measured in accordance with JIS A 1418-1 "Acoustics—Measurement of floor impact sound insulation of buildings—Part 1: Method using standard light impact source" and JIS A 1418-2 "Acoustics—Measurement of floor impact sound insulation of buildings—Part 2: Method using standard heavy impact source". The measurement results were graded based on impact sound pressure level, L, of floor, in accordance with JIS A 1419-2 "Acoustics—Rating of sound insulation in buildings and of building elements—Part 2: Floor impact sound insulation".

(5) Maximum Acceleration

The maximum acceleration was measured in accordance with JIS A 6519 "Steel furring components for gymnasium floors, 9.6 Hardness test of floor". The maximum of acceleration G was measured at locations different in hardness (a point above a beam, a point not above a beam (or a point above an area between beams), a point above a joist, a point not above a joist (or a point above an area between joists), a point satisfying any combination of these conditions). The average of 5 measurements in each point was taken. From (a) an average value at the hardest point (that is, the largest average value) and (b) an average value at the softest point (that is, the smallest average value), the difference (a−b) was calculated, and the resulting values in Examples and Comparative Examples were compared. The hardest point was a point above a beam for all Examples and Comparative Examples; the softest (the most flexible) point was a point not above a beam or a joist for Examples 3 to 12 and Comparative Examples 4 and 6, and a point not above a beam for Comparative Examples 3 and 5.

Production Example 1 of Buffer Member

A sheath-core form conjugated staple fiber ("Sofista" manufactured by Kuraray Co., Ltd., having a fineness of 3 dtex, a fiber length of 51 mm, a mass ratio of the sheath relative to the core of 50/50, a number of crimps of 21/25 mm, and a degree of crimp of 13.5%) was prepared as a thermal adhesive fiber under moisture. The core component of the conjugated staple fiber comprised a polyethylene terephthalate and the sheath component of the conjugated staple fiber comprised an ethylene-vinyl alcohol copolymer (the content of ethylene was 44 mol % and the degree of saponification was 98.4 mol %).

Using the sheath-core form conjugated staple fiber, a card web having a basis weight of about 50 g/m$^2$ was prepared by a carding process. Then six sheets of the card webs were put in layers to give a card web having a total basic weight of about 300 g/m$^2$.

The resulting card web was transferred to a belt conveyor equipped with a 50-mesh stainless-steel endless net having a width of 500 mm. Incidentally, above the belt conveyor, a belt conveyor having the same metal mesh was disposed, the belt conveyors independently revolved at the same speed rate in the same direction, and the clearance between the metal meshes was adjustable arbitrarily.

Then the card web was introduced to a water vapor spraying apparatus attached on the lower belt conveyor. The card web was subjected to a water vapor treatment by spraying the card web (perpendicularly) with a high-temperature water vapor jetted at a pressure of 0.2 MPa from the water vapor spraying apparatus so that the water vapor penetrated the web in the thickness direction of the web to give a shaped product having a nonwoven structure. The water vapor spraying apparatus had a nozzle disposed in the inside of the under conveyor so as to spray to the web with the high-temperature water vapor through the conveyor net. A suction apparatus was disposed inside the upper conveyor. In a downstream side in the web traveling direction with respect to this spraying apparatus, another pair of a nozzle and a suction apparatus in inverse arrangement of the above pair was disposed. In this way, the both surfaces of the web were subjected to the water vapor treatment.

Incidentally, the water vapor spraying apparatus used had nozzles, each having a pore size of 0.3 mm, and these nozzles were arranged in a line parallel to the width direction of the conveyor in a pitch of 1 mm. The processing speed was 3 m/minute, and the clearance (distance) between the upper and lower conveyor belts was adjusted in order to give a nonwoven structure having a thickness of 6 mm. Each of the nozzles was disposed on the backside of the belt so that the nozzle almost contacted with the belt.

The obtained nonwoven structure (shaped product) had a board-like shape, and very hard compared with a conventional nonwoven fabric. The nonwoven structure had an apparent density of 0.05 g/cm$^3$. The nonwoven structure had bonded fiber ratios of 11% at the surface area, 10% at the central area, and 10% at the backside area. The nonwoven structure was cut to give a buffer member 1.

Production Example 2 of Buffer Member

A nonwoven structure having a thickness of 12 mm was produced in the same manner as in Production example 1 of buffer member except that a card web having the number of stacked webs of 17 and a total basis weight of about 850 g/m$^2$ was used and that the clearance (distance) between the upper and lower conveyor belts was adjusted appropriately. The obtained nonwoven structure had an apparent density of 0.07 g/cm$^3$. The nonwoven structure had bonded fiber ratios of 11% at the surface area, 10% at the central area, and 10% at the backside area. The nonwoven structure was cut to give a buffer member 2.

Production Example 3 of Buffer Member

A nonwoven structure having a thickness of 3 mm was produced in the same manner as in Production example 1 of buffer member except that a card web having the number of stacked webs of 12 and a total basis weight of about 600 g/m$^2$ was used and that the clearance (distance) between the upper and lower conveyor belts was adjusted appropriately. The obtained nonwoven structure had an apparent density of 0.2 g/cm$^3$. The nonwoven structure had bonded fiber ratios of 73% at the surface area, 70% at the central area, and 74% at the backside area. The nonwoven structure was cut to give a buffer member 3.

Example 1

A structural plywood having a thickness of 28 mm was installed by a rigid floor method to give a floor backing member having a size of 3600×3600 mm. The floor backing member was disposed on beams, each having a cross section of 120×240 mm, arranged at intervals of 910 mm. Two structural plywoods, each having a thickness of 12 mm and a width of 50 mm, were laminated to give an edge joist having a thickness of 24 mm. The edge joists were arranged on the floor backing member in parallel with a longitudinal direction of the after-mentioned support member and fixed to the floor backing member with nails. As each one of edge joists to be provided in a direction perpendicular to the longitudinal direction of the support member, a structural plywood having a thickness 12 mm and a width of 50 mm was installed, and a further structural plywood having a thickness of 12 mm and a size of 50 mm square was fixed on each of extensions of the support members with a double-faced adhesive tape to form a projection. In such a manner, the edge joist having a partial support structure was installed. Further, each one of joists extending in a direction perpendicular to the longitudinal direction of the support member was installed on the floor backing member in the central region of the longitudinal direction of the support member. The joist had the same structure as the edge joist having the partial support structure. Then two buffer members 1, each having a thickness 6 mm and an apparent density of 0.05 g/cm$^3$, were put in layers and laid on each area surrounded by the edge joists and the joists in the floor backing member. Support members, each comprising a structural plywood having a thickness of 12 mm and width of 50 mm, were then placed at intervals of 303 mm on the buffer member 1. There was a clearance of 10 mm between the edge joist or the joist and the support member in the plane direction (or a clearance of 10 mm in a butting site in the plane direction of the edge joist or the joist and the support member). Structural plywoods, each having a thickness of 12 mm, were butt-joined to each other on the support members, and then a damping member (a sheet having a thickness of 6 mm and a specific gravity of 4.0 obtained by heat-mixing an asphalt and an iron-based inorganic powder and forming the mixture into a plate) was installed. A flooring composed of a plywood having a thickness of 12 mm was installed on the damping member. The flooring was fixed with a 38-mm floor nail so that the flooring was nailed to the support member. A sound insulation floor structure having above-mentioned construction was installed in a room with each end face of each layer of the floor structure being 6 mm away from the wall of the room. A ceiling structure of the downstairs room comprised a beam, a strap suspended from the beam, a ceiling-joist receiver, a ceiling-joist, and a gypsum board having a thickness of 9.5 mm.

Comparative Example 1

On a floor backing member produced in the same manner as Example 1, a flooring composed of a plywood having a thickness of 12 mm was installed.

Comparative Example 2

On a floor backing member produced in the same manner as Example 1, a needle-punched polyester nonwoven fabric having a thickness of 12 mm and a mass per unit area (basis weight) of 1400 g/m$^2$, a damping member having a thickness of 6 mm and a specific gravity of 4.0 and comprising an asphalt as a binder, and a flooring comprising a plywood having a thickness of 12 mm disposed on the damping member was installed.

With respect to each floor structure obtained in Examples and Comparative Examples, the floor impact sound insulation was measured. The results are shown in Table 1.

TABLE 1

| | Example 1 | Comparative Example 1 | Comparative Example 2 |
|---|---|---|---|
| Light impact sound pressure level of floor | 65 | 90 | 80 |
| Heavy impact sound pressure level of floor | 85 | 90 | 85 |

As apparent from the results shown in Table 1, the sound insulation floor structure of Example has an excellent sound insulation, while the sound insulation floor structures of Comparative Examples have a low sound insulation.

Example 2

A floor backing member was produced as follows: a concrete building having a capacity of 30 m$^3$ and an upper opening (size: 1820×1820 mm) was provided; around the upper opening, lumbers, each having a cross section of 120×200 mm, were disposed as a girder; then as beams, two lumbers, each having a cross section of 120×200 mm, were attached parallel with each other to the girder; the distance of each lumber from the center of the upper opening was 455 mm; and structural plywoods, each having a thickness of 24 mm, were disposed at intervals of 150 mm parallel to the beam on the girder and the beam and attached with screws, each having a length of 65 mm. On the floor backing member, a structural plywood having a thickness of 9 mm and a damping member having a thickness of 4 mm (a sheet having a specific gravity of 2.8 obtained by heat-mixing an asphalt and an iron-based inorganic powder and forming the mixture into a plate) were laid in this order. On the damping member, structural plywoods, each of which had a thickness of 9 mm and was cut to 50 mm width, as joists were arranged at intervals of 303 mm parallel to the beam and then fixed with screws, each having a length of 32 mm. Then a buffer member 2 (a nonwoven fabric) having a thickness of 12 mm and an apparent density of 0.07 g/cm$^3$ as a buffer layer was disposed between the joists. A structural plywood having a thickness of 12 mm was disposed on the nonwoven fabric and fixed with screws, each having a length of 32 mm. On the structural plywood, a flooring composed of a plywood having a thickness of 12 mm was installed. 38-mm floor nails were used to fix the flooring so that each floor nail was located above the joist. A sound insulation floor structure having above-mentioned construction was installed in a room with each end face of each layer of the floor structure being 6 mm away from the wall of the room.

Example 3

A sound insulation floor structure was installed in the same manner as in Example 2 except for the following: a damping member having a thickness of 4 mm and a size of 910 mm×910 mm (a sheet having a specific gravity of 2.8 obtained by heat-mixing an asphalt and an iron-based inorganic powder and forming the mixture into a plate) was fixed beforehand on a structural plywood having a thickness of 9 mm and a size of 910 mm×910 mm with an aqueous adhesive composed of an ethylene-vinyl acetate copolymer; the same aqueous adhesive was applied on the damping member; and structural plywoods, each having a thickness of 9 mm and a size of 50 mm×910 mm, as joists were disposed at intervals of 303 mm parallel to each other so that these structural plywoods were located at each end of the damping member and at a distance of 303 mm from each end thereof; then a buffer member 2 having a thickness of 12 mm and an apparent density of 0.07 g/cm$^3$ was disposed between the joists; a structural plywood having a thickness of 9 mm and a size of 910 mm×910 mm and having the same aqueous adhesive applied on a first side thereof was disposed so that the first side of the plywood faced the joist and the buffer member 2, and allowed to stand under a load until the adhesive was dried; thus a sound insulation floor component was produced; and four pieces of the resulting sound insulation floor component were disposed on the floor backing member and fixed with screws, each having a length of 45 mm, at intervals of 150 mm.

Example 4

A sound insulation floor structure was installed in the same manner as in Example 2 except for the following: a buffer member 3 which had a thickness of 3 mm and an apparent density of 0.2 g/cm$^3$ and was cut to 50 mm width was fixed to a structural plywood which had a thickness of 5.5 mm and was cut to 50 mm width with an adhesive to give a joist; the resulting joist was used instead of the joist composed of the structural plywood; the resulting joists were arranged on the damping member at intervals of 303 mm parallel to the beam so that the buffer member 3 was directed downward; and instead of the buffer member 2, a needle-punched polyester nonwoven fabric (average fiber diameter: 25 μm) having a thickness of 12 mm and a mass per unit area (basis weight) of 1000 g/m$^2$ was used as a buffer layer.

Example 5

A sound insulation floor structure was installed in the same manner as in Example 4 except that a buffer member 2 having a thickness of 12 mm and an apparent density of 0.07 g/cm$^3$ was used instead of the polyester nonwoven fabric as a buffer layer.

Example 6

A sound insulation floor structure was installed in the same manner as in Example 2 except for the following: a first structural plywood having a thickness of 9 mm was laid on the floor backing member; a buffer member 3 which had a thickness of 3 mm and an apparent density of 0.2 g/cm$^3$ and was cut to 50 width was fixed to a second structural plywood which had a thickness of 5.5 mm and was cut to 50 mm width with an adhesive to give a joist; the resulting joists were arranged on the first structural plywood at intervals of 303 mm parallel to the beam so that the buffer member 3 was directed downward; the joists were then fixed with screws, each having a length of 32 mm; and a needle-punched polyester nonwoven fabric (average fiber diameter: 25 μm) having a thickness of 12 mm and a mass per unit area (basis weight) of 1000 g/m$^2$ as a buffer layer and a damping member having a thickness of 4 mm (a sheet having a specific gravity of 2.8 obtained by heat-mixing an asphalt and an iron-based inorganic powder and forming the mixture into a plate) as anon-buffer layer were disposed between the joists in this order.

Example 7

A first structural plywood having a thickness of 9 mm, a damping member having a thickness of 4 mm (a sheet having a specific gravity of 2.8 obtained by heat-mixing an asphalt and an iron-based inorganic powder and forming the mixture into a plate), and a second structural plywood having a thickness of 9 mm were laminated beforehand in this order and fixed with an aqueous adhesive composed of an ethylene-vinyl acetate copolymer to produce a constrained damping wood board.

A sound insulation floor structure was installed in the same manner as in Example 2 except for the following: a nonwoven structure which had a thickness of 3 mm and an apparent density of 0.2 g/cm$^3$ and was cut to 50 width was fixed to a structural plywood which had a thickness of 5.5 mm and was cut to 50 mm width with an adhesive to give a joist; the resulting joists were arranged on the floor backing member at intervals of 303 mm parallel to the beam so that the nonwoven structure was directed downward; the joists were then fixed with screws, each having a length of 32 mm; a needle-punched polyester nonwoven fabric (average fiber diameter: 25 μm) having a thickness of 12 mm and a mass per unit area (basis weight) of 1000 g/m$^2$ as a buffer layer was disposed between the joists; and the above-mentioned constrained damping wood board was disposed on the nonwoven fabric and the joists and fixed with screws, each having a length of 32 mm.

Example 8

A sound insulation floor structure was installed in the same manner as in Example 2 except for the following: a damping member having a thickness of 4 mm and a size of 910 mm×910 mm (a sheet having a specific gravity of 2.8 obtained by heat-mixing an asphalt and an iron-based inorganic powder and forming the mixture into a plate) was fixed beforehand on a structural plywood having a thickness of 9 mm and a size of 910 mm×910 mm with an aqueous adhesive composed of an ethylene-vinyl acetate copolymer; a buffer member 3 which had a thickness of 3 mm and an apparent density of 0.2 g/cm$^3$ and was cut to 50 mm width was fixed to a structural plywood which had a thickness of 5.5 mm and was cut to 50 mm width with an adhesive to give a joist; the same aqueous adhesive was applied on the damping member; the resulting joists were disposed at intervals of 303 mm parallel to each other with the nonwoven structure directed downward so that these joists were located at each end of the damping member and at a distance of 303 mm from each end thereof; then a buffer member 2 having a thickness of 12 mm and an apparent density of 0.07 g/cm$^3$ was disposed between the joists; a structural plywood having a thickness of 9 mm and a size of 910 mm×910 mm and having the same aqueous adhesive applied on a first side thereof was disposed so that the first side of the plywood faced the joist and the buffer member 2, and allowed to stand under a load until the adhesive was dried; thus a sound insulation floor component was produced; and four pieces of the resulting sound insulation floor component were disposed on the floor backing member and fixed with screws, each having a length of 45 mm, at intervals of 150 mm.

Comparative Example 3

On the floor backing member, a flooring composed of a plywood having a thickness of 12 mm was installed.

Comparative Example 4

A sound insulation floor structure was installed in the same manner as in Example 1 except that the buffer member between the joists was not used.

Comparative Example 5

A damping member having a thickness of 8 mm (a sheet having a specific gravity of 2.8 obtained by heat-mixing an asphalt and an iron-based inorganic powder and forming the mixture into a plate) was laid on the floor backing member, and a flooring composed of a plywood having a thickness of 12 mm was installed on the damping member.

Comparative Reference Example 6

A sound insulation floor structure was installed in the same manner as in Example 4 except that structural plywoods, each of which had a thickness of 9 mm and was cut to 50 mm width, as joists were disposed at intervals of 303 mm parallel to each other and perpendicular to the beam.

The floor structures obtained in Examples 2 to 8 and Comparative Examples 3 to 6 were tested for the floor impact sound insulation. The results are shown in Table 2.

TABLE 2

| | | Examples | | | | | | | Comparative Examples | | | |
|---|---|---|---|---|---|---|---|---|---|---|---|---|
| | | 2 | 3 | 4 | 5 | 6 | 7 | 8 | 3 | 4 | 5 | 6 |
| Light impact sound pressure level of floor | | 83 | 81 | 80 | 78 | 80 | 76 | 77 | 94 | 95 | 87 | 85 |
| Maximum acceleration | Hard point (a) | 79 | 78 | 71 | 71 | 73 | 70 | 73 | 109 | 80 | 110 | 106 |
| | Soft point (b) | 78 | 77 | 67 | 69 | 72 | 68 | 72 | 62 | 61 | 69 | 77 |
| | Difference (a − b) | 1 | 1 | 4 | 2 | 1 | 2 | 1 | 47 | 19 | 42 | 29 |

As apparent from the results shown in Table 2, the sound insulation floor structures of Examples have an excellent sound insulation, while the sound insulation floor structures of Comparative Examples have a low sound insulation and a large difference in the maximum acceleration G. Moreover, the sound insulation floor structure of Example 4 is superior in sound insulation to the sound insulation floor structure of Comparative Example 6.

INDUSTRIAL APPLICABILITY

The sound insulation floor structure of the present invention is usable for a floor structure of a building (for example, an apartment house or a condominium, an office building, and a dwelling house). In particular, the sound insulation floor structure is useful as a floor structure of the second or higher floor in a multi-storied building (e.g., an apartment house or a condominium, an office building, and a dwelling house).

DESCRIPTION OF REFERENCE NUMERALS

1, 11 . . . Floor backing member
2, 14 . . . Buffer layer
3 . . . Air layer
4, 12, 15, 22, 25 . . . Hard layer
4*a* . . . Butting site of wood boards
5, 16 . . . Floor finishing layer
6 . . . Support member
7, 17 . . . Damping layer
8 . . . Edge joist
9, 13, 23 . . . Joist
10 . . . Wall
20, 30 . . . Sound insulation floor component
24 . . . Compressable layer (buffer layer)

The invention claimed is:

1. A sound insulation floor structure comprising:
a floor backing member;
a floor finishing layer; and
an intermediate layer between the floor backing member and the floor finishing layer, the intermediate layer comprising a buffer member comprising a nonwoven structure;
wherein the intermediate layer is formed with a plurality of joists and a plurality of buffer layers, the joists and the buffer layers are disposed alternately, and the joists are disposed parallel to each other at intervals,
wherein the buffer layer is a compressed layer obtained by compressing a compressable layer to a thickness of each one of the joists, wherein the compressable layer comprises the buffer member and has a thickness larger than a thickness of each one of the joists, and
wherein the nonwoven structure comprises a thermal adhesive fiber under moisture, and wherein the thermal adhesive fiber is melt-bonded to a fiber of the nonwoven structure to fix the fibers.

2. The sound insulation floor structure according to claim 1, wherein
the joists comprise the buffer member.

3. The sound insulation floor structure according to claim 1, further comprising an air layer and a hard layer between the intermediate layer and the floor finishing layer, and further comprising a support member in the air layer between the intermediate layer and the hard layer.

4. The sound insulation floor structure according to claim 3, wherein the support member has a quadrangular cross section and is long, wherein a plurality of the support members are disposed parallel to each other at intervals, and wherein the support members occupy 10 to 70% of a floor area.

5. The sound insulation floor structure according to claim 4, wherein the joists comprise a joist which is disposed perpendicular to the long support member for partly supporting the hard layer.

6. The sound insulation floor structure according to claim 1, further comprising a first hard layer between the floor backing member and the buffer layer, and a second hard layer between the buffer layer and the floor finishing layer.

7. The sound insulation floor structure according to claim 1, wherein the nonwoven structure for forming the buffer member has a bonded fiber ratio of 3 to 85% and an apparent density of 0.03 to 0.2 g/cm$^3$.

8. The sound insulation floor structure according to claim 2, wherein the nonwoven structure for forming the buffer member has a bonded fiber ratio of 3 to 85% and an apparent density of 0.07 to 0.35 g/cm$^3$.

9. The sound insulation floor structure according to claim 1, wherein the joists are disposed parallel to a beam which is positioned between adjacent joists.

10. The sound insulation floor structure according to claim 1, wherein the buffer layers and the joists are disposed alternately and adjacently.

11. The sound insulation floor structure according to claim 1, further comprising a damping layer between the floor backing member and the floor finishing layer.

12. The sound insulation floor structure according to claim 11, wherein the damping layer contain an asphalt.

13. The sound insulation floor structure according to claim 1, wherein a clearance is formed between the intermediate layer and a surface of a wall.

14. A sound insulation floor component comprising:
a plurality of joists to be disposed parallel to each other at intervals; and
a plurality of compressable layers, each having a thickness larger than a thickness of each one of the joists, wherein the joists and the compressable layers are disposed alternately,
wherein the joists, the compressable layers, or both contain a buffer member, wherein the buffer member comprises a nonwoven structure, and wherein the nonwoven structure comprises a thermal adhesive fiber under moisture which is melt-bonded to a fiber of the nonwoven structure to fix the fibers,
wherein the compressable layers and the joists are disposed alternately and adjacently, and
wherein the compressable layer comprises the buffer member and has a thickness larger than a thickness of each one of the joists.

15. The sound insulation floor component according to claim 14, wherein each one of the compressable layers comprises a buffer layer comprising a buffer member, and wherein the buffer layer has a thickness of 1.05 to 3 times as large as the thickness of each one of the joists.

16. The sound insulation floor component according to claim 14, wherein each one of the compressable layers comprises a buffer layer comprising the buffer member and a non-buffer layer laminated on one side of the buffer layer, wherein the buffer layer has a thickness of 1.05 to 3 times as large as a reference thickness, and wherein the reference thickness is determined by subtracting the thickness of the non-buffer layer from the thickness of each one of the joists.

17. The sound insulation floor component according to claim 16, wherein the non-buffer layer comprises a damping member.

18. The sound insulation floor component according to claim 16, wherein the non-buffer layer forms a space portion.

19. The sound insulation floor component according to claim 14, wherein the area ratio of the joists and the compressable layers in a floor area is 10/90 to 30/70 in a ratio of the joists/the compressable layers.

20. The sound insulation floor component according to claim 15, wherein the buffer layer uncompressed comprises a nonwoven structure having a thickness of 3 to 60 mm and an apparent density of 0.03 to 0.2 g/cm$^3$.

21. The sound insulation floor component according to claim 14, further comprising a damping layer.

22. The sound insulation floor component according to claim 14, further comprising a first hard layer, wherein the joists are disposed parallel to each other at intervals on one side of the first hard layer.

23. The sound insulation floor component according to claim 22, further comprising a second hard layer disposed on the joists and the compressable layers, wherein each one of the compressable layers is compressed to a thickness of each one of the joists.

24. The sound insulation floor component according to claim 22, wherein the joists and the compressable layers are fixed to each of the first hard layer and the second hard layer with an adhesive or a pressure sensitive adhesive.

25. The sound insulation floor component according to claim 23, further comprising a damping layer which is disposed, with fixing by an adhesive or a pressure sensitive adhesive, between the first hard layer or the second hard layer and an arrangement of the joists and the compressable layers.

26. A method for reducing a floor impact sound, comprising applying a buffer member to a floor structure, wherein the buffer member comprises a nonwoven structure comprising a thermal adhesive fiber under moisture which is melt-bonded to a fiber of the nonwoven structure to fix fibers.

* * * * *